US009937400B2

(12) United States Patent
Hart

(10) Patent No.: US 9,937,400 B2
(45) Date of Patent: Apr. 10, 2018

(54) AUTOMATIC BALL PITCHING MACHINE

(71) Applicant: Thomas Hart, Fenton, MO (US)

(72) Inventor: Thomas Hart, Fenton, MO (US)

( * ) Notice: Subject to any disclaimer, the term of this patent is extended or adjusted under 35 U.S.C. 154(b) by 0 days.

(21) Appl. No.: 14/986,456

(22) Filed: Dec. 31, 2015

(65) Prior Publication Data

US 2016/0193520 A1 Jul. 7, 2016

Related U.S. Application Data

(60) Provisional application No. 62/098,698, filed on Dec. 31, 2014.

(51) Int. Cl.

| | |
|---|---|
| ***F41B 4/00*** | (2006.01) |
| ***A63B 69/00*** | (2006.01) |
| ***A63B 69/40*** | (2006.01) |
| ***A63B 71/06*** | (2006.01) |
| *A63B 102/02* | (2015.01) |
| *A63B 102/18* | (2015.01) |

(52) U.S. Cl.

CPC ..... *A63B 69/0002* (2013.01); *A63B 69/40* (2013.01); *A63B 69/406* (2013.01); *A63B 71/0622* (2013.01); *A63B 69/0053* (2013.01); *A63B 2069/0008* (2013.01); *A63B 2069/0011* (2013.01); *A63B 2069/401* (2013.01); *A63B 2069/402* (2013.01); *A63B 2071/065* (2013.01); *A63B 2071/0675* (2013.01); *A63B 2071/0694* (2013.01); *A63B 2102/02* (2015.10); *A63B 2102/18* (2015.10); *A63B 2102/182* (2015.10); *A63B 2207/02* (2013.01); *A63B 2225/09* (2013.01); *A63B 2225/093* (2013.01); *A63B 2225/50* (2013.01); *A63B 2243/0025* (2013.01)

(58) Field of Classification Search

CPC ..... A63B 69/406

See application file for complete search history.

(56) References Cited

U.S. PATENT DOCUMENTS

| | | | | | |
|---|---|---|---|---|---|
| 4,352,348 | A * | 10/1982 | Griffith | A63B 69/406 124/34 |
| 4,423,717 | A * | 1/1984 | Kahelin | A63B 69/406 124/78 |
| 5,125,653 | A * | 6/1992 | Kovacs | A63B 69/406 124/78 |
| 5,464,208 | A * | 11/1995 | Pierce | A63B 69/406 124/78 |
| 6,182,649 | B1 | 2/2001 | Battersby | |

(Continued)

*Primary Examiner* — John Ricci

(74) *Attorney, Agent, or Firm* — Creativenture Law, LLC; Dennis JM Donahue, III

(57) ABSTRACT

An automatic game ball throwing machine. The ball thrower includes a base, a support frame attached to the base, a drive wheel mechanism attached to the support frame, and a human-machine interface which enables customization of ball spin, speed and target location. A light source can be attached to the machine to illuminate each ball at one or more launch points. Further, a launching frame indexing element can be positioned to control the location of the ball target. A resident software program integrates the throwing machine, indexing element and human-machine interface, calculating pitch parameters and converting them to machine outputs to enable customization of pitch variety and characteristics.

23 Claims, 25 Drawing Sheets

(56) References Cited

U.S. PATENT DOCUMENTS

| | | | | |
|---|---|---|---|---|
| 6,470,873 | B2 * | 10/2002 | Battersby | A63B 69/406 124/78 |
| 6,539,931 | B2 * | 4/2003 | Trajkovic | A63B 24/00 124/32 |
| 6,546,924 | B2 | 4/2003 | Battersby | |
| 7,082,938 | B2 * | 8/2006 | Wilmot | A63B 69/406 124/78 |
| 8,550,063 | B2 * | 10/2013 | Alger | A63B 69/406 124/6 |
| 9,010,309 | B2 * | 4/2015 | Lewis | A63B 69/40 124/4 |

* cited by examiner

AUTOMATIC BALL PITCHING MACHINE

CROSS-REFERENCES TO RELATED APPLICATIONS

This application claims benefit of the following patent application(s) which is/are hereby incorporated by reference: Automatic Ball Pitching Machine, Application No. 62/098,698 filed 31 Dec. 2014

This is a Non-Provisional Utility patent application for the disclosure of an "AUTOMATIC BALL PITCHING MACHINE."

A portion of the disclosure of this patent document, including the computer program listing, contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

See Specification Appendix for computer listing program as a reduction to practice ascertainable to those skilled in the art.

BACKGROUND OF THE DISCLOSURE

The present disclosure relates generally to devices that launch or throw sports balls. More particularly, the current disclosure relates to an automatic game ball throwing machine particularly suited to throwing baseballs, softballs and batting practice balls, but can also be used with any substantially round ball include soccer, tennis and other sport balls.

There are ball throwing machines used in numerous sports that assist during the playing of a sport or enable players to practice certain aspects of a sport. One example of machines aiding in the playing and/or participation of a sport includes the use of game ball throwing machines. These machines are used to throw or launch the ball used in a particular sport.

For example, in a sport such as football, tennis, soccer, cricket, basketball, lacrosse, baseball, and softball, machines are used to launch or throw a ball toward a player to facilitate or simulate the movement of that ball as it would typically occur during the playing of that sport. For example, in tennis, tennis ball machines are used to send balls to players during practice so they can work on their game techniques. In American football, football throwing machines are used to simulate either a quarterback's throw to allow receivers to practice catching the ball. This general concept of using machines to simulate the movement of a ball permeates most sports.

One sport in particular, diamond sports such as baseball and softball, have a type of machine generally referred to as a pitching machine. This pitching machine is a game ball throwing machine that is used to simulate the throw of a ball by a pitcher. These machines are typically used in batting practice but can also be used to simulate a pitched ball for a catcher or a hit ball from a batter to assist players in the field to work on various fundamentals. While the subject claims of this application includes pitching for batting and throwing fielding practice, as well as for launching balls for other sports, for simplicity this multipurpose invention is herein defined as a pitching machine, and the location desired for the ball, whether into a batter's strike zone or into a fielder's position is defined as aimpoint, impact point and target location and type.

Typically, these pitching machines have conventionally required a person, such as another player or coach, to stand beside the machine and manually adjust the aim-point, velocity and amount and direction of curve or spin in various directions. This is time consuming, dangerous to the person operating the machine, and does not simulate the typical time required for a human pitcher to throw pitches of different types in a game situation. This practice has evolved to the implementation of automatic ball pitch programmers. These machines in prior art involve a controller which is preprogrammed by the manufacturer using a standard database lookup table of values to throw a standard-type pitch with a preprogrammed velocity and direction and amount of spin, representing a type of pitch such as a curveball, fastball or slider. The drawback to this mechanism is it assumes a generic pitch by type, rather than the real-world situation in which all human pitchers have unique nuances, speeds, locations and amounts of spin for a given type of pitch. The second drawback is there is no ability to alter any parameters and have the ball delivered to a desired location on the plate. For example, a little league pitcher may throw a 50 MPH fastball that drops eight inches from release to arrival at the front of the plate, with a curve to the right of one inch, while a high school pitcher may throw a 70 MPH fastball that drops six inches in the same interval with two inches of curve to the right. The same two pitchers may throw their respective fastballs, and other pitches, differently as a strategy, or due to fatigue as the game continues. These subtle nuances are not simulated by prior art which utilize a set table of variables for each type of pitch.

Another drawback to prior art pitching machines is they do not enhance or emphasize a critical aspect to successful batting by a player, namely for the batter to focus on the ball as it is being released. While there is prior art which uses a warning light, pointed at the batter, to signify a ball is about to be launched, this does not simulate a real game situation. Since there is no 'wind-up' by a typical wheeled pitching machine, there has not been a prior reliable system to encourage, enable and allow the batter to focus on the ball at or near the point of release.

All machines require a method to adjust pitch location. There are many ways to adjust the aim of the machine, including moving the base structure, moving the arm mechanism relative to the structure, and changing the release point of the ball. Methods may be manual or automated depending on the particular embodiment, but numerous methods have been established in prior art of both pitching machines and mechanisms in general, such as gear trains, stepper motors, linear actuators, sprockets, belts, etc. However, all prior art has had numerous drawbacks, particularly in their failure to simulate the variety of pitches and the speed with which they vary, in a game situation.

What is needed then is an improved game ball throwing machine that easily and safely alters the aspects of various pitches and human pitchers actually encountered in a game, and that teaches a player to focus on and pick up visually a pitched ball at the moment it is released toward the batter. This improved game ball thrower preferably has multiple pitch parameters and easily interpreted graphical user interface is designed to avoid restricted pitch parameter options and limited interfaces that are prevalent in prior art ball feeding machines. This needed game ball throwing machine is lacking in the art.

A major factor in wheel pitching machine inaccuracy is the variance in the size and compressibility of the balls used. Laces can also cause a wide error in mechanized pitching, because there is no way to know how the laces will be positioned when the wheels grab it. Spring loading the wheels (or the motors if directly connected to the wheels) greatly reduces the machine's sensitivity to ball variance. It effectively lowers the spring rate of the existing fixed assembly, so that minor differences in ball size have a much lower effect on the clamping force between the wheels (or wheel and pad for a one wheel machine). For two wheel machines, the motors can be mounted on common linear shafts, with the shafts forming the base structure of the machine's frame.

DETAILED DESCRIPTION

Low cost, commercially available microcontrollers and microprocessors are used to control the machine. The specific hardware used is not critical, but some possible selections are the Raspberry Pi, Beaglebone Black, or any similar device which supports web hosting or wireless communication either natively or with additional hardware, and provides GPIO (General Purpose Input/Output). Control signals and sensors interface to and control and sense the real-world the hardware in a traditional manner. What is novel, is the unique algorithm means within the system software which integrates the signals, sensors and hardware together with a unique and novel interface device.

The user interface is accomplished via a standard wireless touchscreen device, such as a tablet or smartphone, running a standard web browser, coupled with the novel software system of the subject invention. The invention can used with a web browser, or custom written application. The Program may be run on any wireless device and/or host device (Raspberry Pi, etc.) One can use VNC (virtual network communication) protocol to connect the wireless device to the host device.

The machine's control system includes a web server and wireless interface. The user loads the web pages hosted by the web server and controls the machine by manipulating the inputs shown on the interactive web pages. Through use of the unique software, it is also possible to create custom applications based on the touchscreen's operating system, for download from the internet.

The embodiment shown in FIG. 1 includes a manual vertical adjustment via threaded rod, where the cylinder and crank assembly rotates on the same axis as the arm. Rotating this assembly moves the release point and release angle, thus changing the vertical location of the pitch.

There are several modes for the machine to operate in, so there are several specialized pages to load. Some of these modes are: machine setup, custom pitch, help, defensive drills, one touch pitch selection, and random sequence. The one touch screen provides a grid of buttons that set the machine for a large variety of pitches with a single touch to allow the fastest possible pitch selection. The random sequence mode allows users to select from a menu of available pitches at a range of pitch speeds. Users may select as many pitches from the menu as desired. Each mode includes tools for the user to select pitch location.

The user interface can be used on any style of machine (wheeled, arm, air cannon) and is described in more detail later in this specification.

It can be difficult to make small adjustments to a typical pitching machine because they are so heavy and unbalanced, and the movements are so small. Some manufacturers have added worm gears or threaded rods to aid the user, but these are cumbersome, inaccurate and time consuming to adjust, resulting in a less than realistic simulation of a pitcher varying locations of his pitches to the batter during a game.

Two methods disclosed in the subject invention to remedy this shortcoming in the prior machines are: 1) adding geared (or ungeared) step motors to the adjustment mechanism and 2) adding a visible scale so the user has a reference to easily see how far they have moved the machine. The scale can be divided into units of distance as measured at the pitch's destination (typically home plate) as opposed to actual distance moved at the machine, for easier understanding by the user.

As mentioned earlier, an unmet need in the prior art was to teach batters to focus on the ball as it is pitched, versus a light shining toward the batter as in prior art. Even when the ball is visible from a distance, it is not obvious to a hitter the exact time that ball will be thrown by a pitching machine. A localized light source at the ball's exit, illuminating the face of the ball visible to the batter, provides a visual cue to the batter that the pitch is being thrown and drawing attention to the ball. Existing machines have warning lights to indicate an imminent pitch, but the design of the subject invention results in a benefit unanticipated by those skilled in the art, in that it allows the hitter to focus on the ball itself, not an indicator off to the side. A related improvement could also entail additional lights, possibly of different colors placed along the ball's path shining on a portion of the ball, which can be used as a timing aid.

A pitching machine must have a user interface of some kind to allow a user to control the machine. Most wheeled pitching machines provide individual motor speed controls for each wheel, typically a manually turned rotary potentiometer. While flexible, this method does not make it obvious to the user how to throw each type of pitch, or even how fast it will be. Several manufacturers resort to tables of values as a guide for the user to set manually, but these are cumbersome and can't cover all available pitches. Other manufacturers have added push button control, where users select a pitch by name and a speed, and the wheel speeds are set automatically. The downfall here is that pitch names are not universal, and again, not every pitch the machine could throw is selectable.

The subject invention disclosed herein, allows users to explicitly set a pitch speed, spin direction, and spin amount. Ball spin translates into the curve or break of a pitch. All three settings can be continuous or discrete amounts. The interface shown in FIG. 7 shows 12 spin directions and 4 spin amounts, but any number may be used. This system provides users with a method to easily select any possible pitch, even if they don't know what it is called.

Selecting a pitch by name can provide a convenient, although limited method of user input. This new system can be extended to include pitch names as an alternative input method. If a pitch is selected by name, the corresponding spin direction is still displayed for confirmation. If a direction is selected, the corresponding pitch name is displayed for confirmation. This system provides consistency between the two methods of selecting a pitch.

On one and two wheeled pitching machines, the plane of the wheel(s) defines the axis of ball spin. To change the direction of spin on these machines, the section of the machine housing the wheels must be rotated. By mounting the spin direction and/or amount displays on the rotating section, a simplified display may be used, as shown in FIG. 8. The direction of spin is limited to one of two opposite directions defined by the wheel orientation, so when the machine rotates, the display rotates with it, keeping the display at the correct orientation.

For one and two wheel machines, the display can also be located on the fixed portion of the machine, but the adjustable section must still be rotated either manually, or automatically by the control system, to match the selected spin direction. If the rotation is manual, the control system can feature a graphical display showing the user how to orient the machine for the selected pitch.

As an obvious variation to the disclosed novel invention, one can also add a feature to change the displayed units of velocity (miles per hour or kilometers per hour, for example) as selected by the user.

Another shortcoming in the prior art is the inability to quickly adjust for differences in balls. At a given wheel speed, a heavier ball will be thrown at a slower velocity than a lighter ball. By adding an input selection for type of ball (baseball or softball, for example), the displayed pitch speed can be corrected, based on the weight of the ball selected.

The user interface described above provides a benefit not realized before by those skilled in the art of pitching machines. The software and hardware configuration of the subject invention provides users a simple, direct method for specifying pitch parameters on any type of machine. These input parameters can easily be used to calculate the individual wheel speeds required to generate the selected pitch.

Because the user may not be familiar with amount of spin used with typical pitches, (RPM of an average curveball, for example), it is convenient to select a maximum reasonable spin amount, say 3600 RPM, and let the user select a percentage of that maximum amount. For calculation, it is also convenient to express the spin amount setting as tangential wheel speed difference. For example, a 25 mph difference on a two wheel machine set to throw a pitch of 50 mph would give tangential wheel speeds of 25 and 75 (50+/−25).

For arithmetic calculations, a frame of reference or coordinate system must be defined for spin direction. It is convenient to select the vertical direction to be 0 degrees, with angles increasing in a clockwise direction, as seen by the machine operator.

On a multiple wheel machine with inputs:

PS=pitch speed

ANG1=direction of spin measured as an angle

SPNPCT=amount of spin, a percentage of the maximum tangential wheel speed difference MAXSPIN=maximum tangential wheel speed difference for each wheel positioned at an angle ANG2, tangential wheel speed WS may be calculated as $$WS=PS-SPNPCT*\cos(ANG2-ANG1)*MAXSPIN.$$

So for the 3 wheel machine shown in FIG. 9, with wheel angles of 60, 180, and 300 degrees:

$$WS1=PS-SPNPCT*\cos(60-ANG1)*MAXSPIN$$

$$WS2=PS-SPNPCT*\cos(180-ANG1)*MAXSPIN$$

$$WS3=PS-SPNPCT*\cos(300-ANG1)*MAXSPIN$$

For a two wheel machine, the wheel angles are 0 and 180 degrees, simplifying the equations to:

$$WS1=PS-SPNPCT*MAXSPIN$$

$$WS2=PS+SPNPCT*MAXSPIN$$

where the ball spins towards the slower wheel.

A computer program written in C for a 3 wheel machine was included in a separate attachment to the provisional application incorporated herein by reference, and also a part of the file wrapper for this non-provisional application as an appendix. This program takes digital inputs from the switches shown in FIG. 7 and controls the multiple LEDs also shown in FIG. 7 to create a display indicating pitch speed, spin direction, and spin amount. The program also writes values to three digital potentiometers to control the wheel speeds.

Other machines have used tables of values obtained by trial and error to aim their machines. These values are programmed by either the manufacturer or the user, but always by trial and error. This limits the available number of pitches. The inventive system disclosed herein is different. The achieved goal by this invention, lacking in the prior art, is to modify the aim of the machine automatically so that no matter how the pitch is changed by the user (speed, curve direction, or curve amount), the ball ends up in the same place when it crosses the plate. Whenever a pitch is changed:

1) the pitch trajectory is calculated, giving data for the theoretical impact point, X and Y.

2) the impact point is compared to the impact point of the previous pitch, X and Y.

3) the machine's aim is adjusted by the difference, so that each pitch will impact the same point Impact point may be adjusted manually, but it will affect all pitches. Impact point, or aimpoint, is the horizontal and vertical location of a pitch as it crosses the plate. The following includes all variables used, their definition, units, and how they were derived—hard numbers defined by the hardware, user inputs, and calculated values. The variables and formulae disclosed herein all are resident within the unique nonobvious software program used in the subject invention, and are herein referred to as arithmetic formulae for simplicity, and serve as full disclosure of the claimed software. Further explanation is below:

| variables | description | units | origin | sample input | notes |
|---|---|---|---|---|---|
| maxspin | max ball spin | RPM | constant | 750 | |
| stepsize | step per pulse | degrees | constant | 0.0383 | =1.8/47 |
| pitchspeed | pitch speed | mph | user input | 72 | |
| z | distance to plate | ft | user input | 55 | |
| spinangle | ball spin angle | degrees | user input | 90 | 0 = up, CW is positive |
| spinamount | % of max spin | % | user input | 50 | |
| CLift | coeff.of lift | in/(s^2 * RPM * mph^2) | user input | 0.00003 | not std def of Clift |
| spinamountRPM | ball spin amount | RPM | calculated | 375 | |
| acc-x | horizontal acceleration | in/s^2 | calculated | 58.32 | |

-continued

| variables | description | units | origin | sample input | notes |
|---|---|---|---|---|---|
| acc-y | vertical acceleration | in/s^2 | calculated | −386.40 | gravity = −386.4 |
| t | time in flight | s | calculated | 0.52 | |
| x | horizontal distance | inches | calculated | 7.91 | |
| y | vertical distance | inches | calculated | −52.41 | |
| ang-x | horizontal angle | degrees | calculated | 0.69 | |
| ang-y | vertical angle | degrees | calculated | −4.54 | |
| xstep | hor steps | steps | calculated | −18 | left <0 |
| ystep | ver steps | steps | calculated | 119 | down <0 |

Calculations spinamountRPM=(spinamount/100)*maxspin acc-*x*=sin(radians(spinangle))*
spinamountRPM*CDrag*pitchspeed^2 acc-*y*=cos(radians(spinangle))*
spinamountRPM*CDrag*pitchspeed^2

*t*=*z*/1.4667**v*)

*x*=0.5*acc-*x**t*^2

*y*=0.5*acc-*x**t*^2 ang-*x*=degrees(arctan(*x*/(*z**12)))

ang-*y*=degrees(arctan(*y*/(*z**12)))

*x*step=−int(ang-*x*/stepsize+0.5)

*y*step=−int(ang-*y*/stepsize+0.5)

Manual Slider Adjustments

| | | | | |
|---|---|---|---|---|
| xslide | horizontal distance | inches | user input | 6 |
| yslide | vertical distance | inches | user input | 12 |
| ang-xm | horizontal angle | degrees | calculated | 0.52 |
| ang-ym | vertical angle | degrees | calculated | 1.04 |
| xstepm | hor steps (manual) | steps | calculated | 14 |
| ystepm | ver steps (manual) | steps | calculated | 27 |

Slider Calculations ang-*xm*=degrees(arctan(*x*slide/(*z**12)))

ang-*ym*=degrees(arctan(*y*slide/(*z**12)))

*x*step*m*=−int(ang-*xm*/stepsize+0.5)

*y*step*m*=−int(ang-*ym*/stepsize+0.5)

maxspin—The maximum wheel speed difference used to spin the ball, measured in RPM. Ball spin is created by spinning the throwing wheels at different speeds. It is an arbitrary value used to ease pitch specification by allowing users to specify spin by percentage instead of RPM.
stepsize—the step angle of the aiming stepper motor, including any gears
pitchspeed—pitch speed
z—distance from machine to plate
spinangle—direction of ball spin
spinamount—amount of ball spin as a percentage of maxspin
CLift—coefficient of lift, a value used to calculate the ball's acceleration perpendicular to its travel from spinning. Based on ball spin and velocity. Not the same as the general engineering term. Can be user adjusted to account for air density and ball condition.
spinamountRPM—calculated value of ball spin in RPM
acc-x—horizontal acceleration
acc-y—vertical acceleration, includes gravity
t—calculated time in flight
x—calculated distance ball moves horizontally during flight
y—calculated distance ball moves vertically during flight
ang-x—angle ball moves horizontally during flight
ang-y—angle ball moves vertically during flight
xstep—number of stepper motor steps to sweep ang-x
ystep—number of stepper motor steps to sweep ang-y
xslide—horizontal distance adjustment measured at impact point
yslide—vertical distance adjustment measured at impact point
ang-xm—angle adjustment to cause xslide distance adjustment
ang-ym—angle adjustment to cause yslide distance adjustment
xstepm—number of stepper motor steps to sweep ang-xm
ystepm—number of stepper motor steps to sweep ang-ym

BRIEF SUMMARY OF THE DISCLOSURE

Disclosed herein is a game ball throwing machine which is automatically programmed to accept a variety of inputs, calculate the required aim-point based on the inputs, and adjust the various electromechanical systems to deliver the game ball to an input desired target location, regardless of amount of spin, direction of spin, intensity of amount of spin input by the user. This represents a major departure from prior art, which historically has required the user to rely on trial and error to vary these parameters to deliver a ball to a specified spot above the batter's home plate.

It is therefore a general object of the present invention to provide a game ball thrower for delivering balls to a batter in a customized random pattern of spins, velocities and directions. Another object of the present disclosure is to provide an improved game ball pitching machine that enhances batter focus on the ball as it is pitched. Still another object of the present disclosure is to provide an automated game ball pitching machine interface that provides an easy to understand visual representation of the area above the home plate. Yet still another object of the present disclosure is to provide an automated game ball feeder that adjusts for differences in ball diameter, weight and seam location. Other and further objects, features and advantages of the present disclosure will be readily apparent to those skilled in the art upon reading of the following disclosure when taken in conjunction with the accompanying drawings.

DETAILED DESCRIPTION OF THE DRAWINGS

Figure 1:
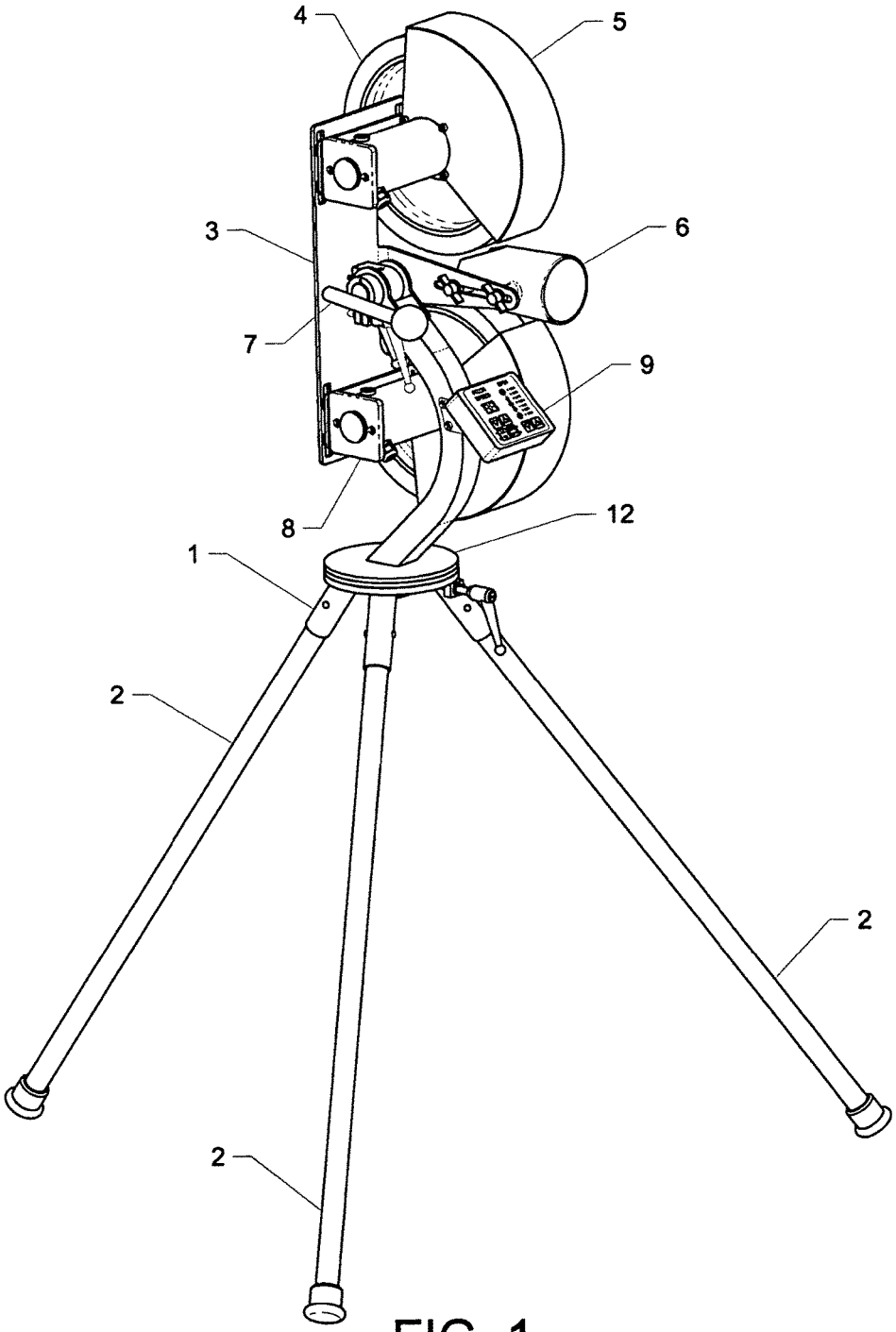
FIG. 1: Front trimetric view of the present invention.

FIG. 1: Two-wheeled front trimetric: Machine follows convention of a base tripod, 1, with removable legs, 2, supporting an upper frame structure, 12, which pivots on a vertical (yaw) axis. There is a motor mounting plate, 3, which pivots on a horizontal axis (pitch) with respect to 12 allowing for vertical aiming. Motor plate also rotates on a second horizontal axis (roll), allowing the motor plate orientation to twist, or be rotated into any plane parallel to the vertical aiming axis. Motors, 8, are fastened to the motor mounting plate in a manner that allows the gap between wheels, 4, to be easily adjusted. Wheels 4, and wheel guards 5, are directly attached to the motors, 8, so they move with the motors as an assembly. The ball feed tube, 6, is removable to allow for different ball sizes. Removable handle, 7, provides the user a convenient place to grip the machine for adjusting its aim. Control panel, 9, provides user a means for controlling the machine. Controls on the panel, 9, allow user to control both wheel speeds and the aim of the machine.

Figure 2:
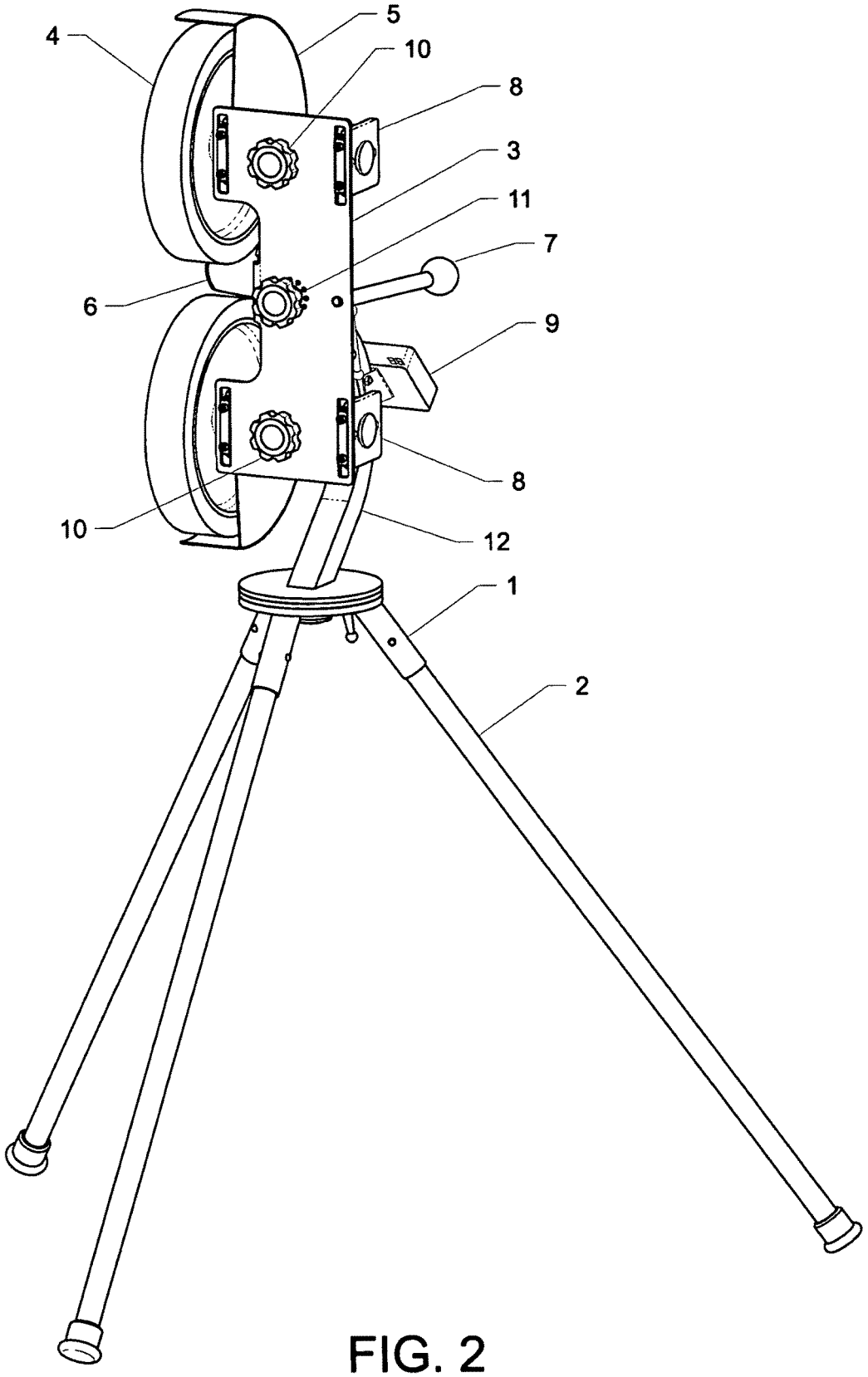
FIG. 2: Back trimetric view of the present invention.

FIG. 2: Two-wheeled back trimetric: Motors and wheels, 8 &4, are held in place on the motor mounting plate, by threaded clamping knobs, 10. A similar threaded clamping knob, 11, holds the motor mounting plate, 3, in place, providing a method for adjusting the roll angle of the machine.

Figure 3:
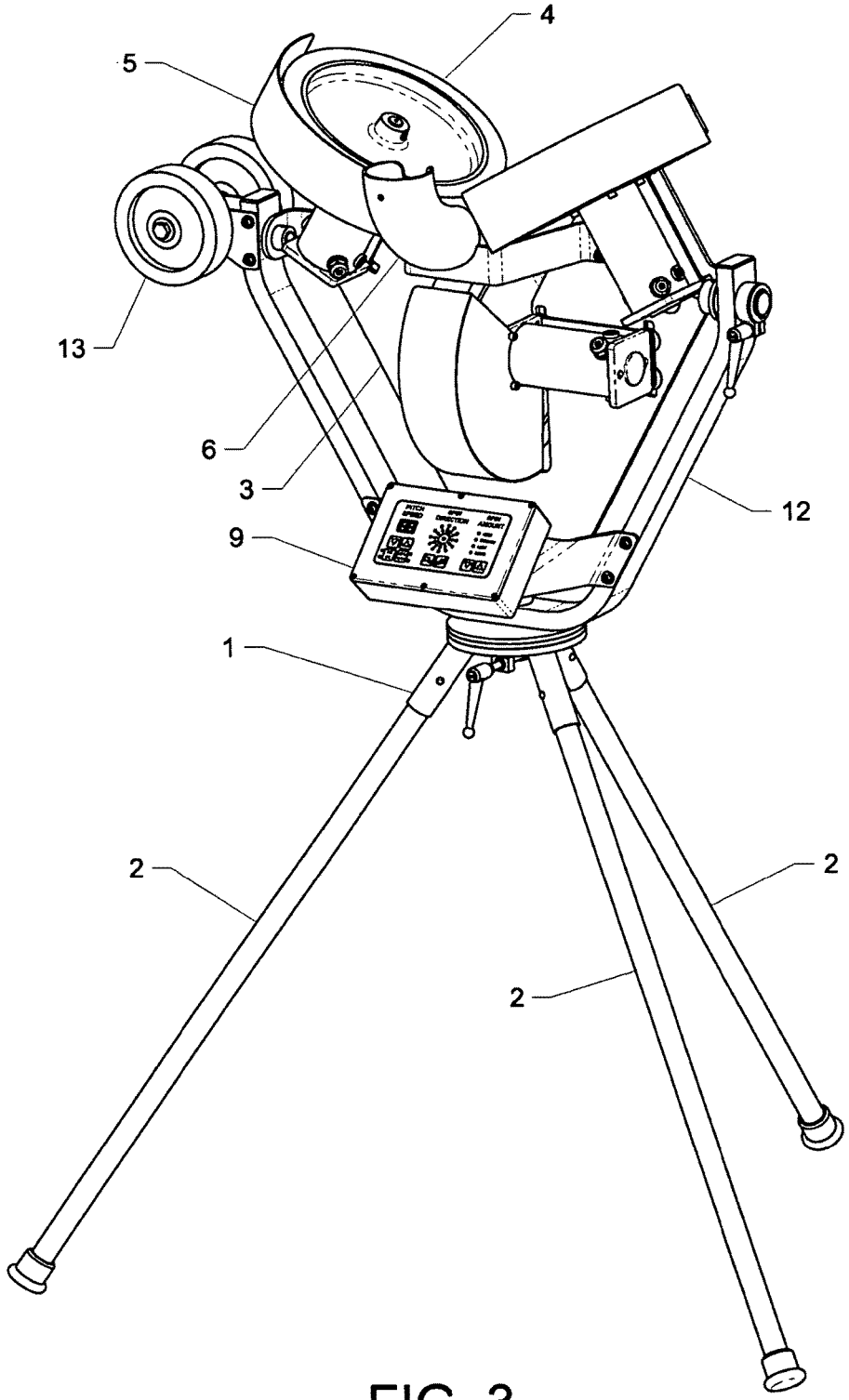
FIG. 3: Front trimetric view of the present invention detailing three-wheeled.

FIG. 3: Three-wheeled front trimetric: Same concepts as the 2 wheel embodiment, except there is no roll adjustment needed. Removable transport wheels, 13, have been added.

Figure 4:
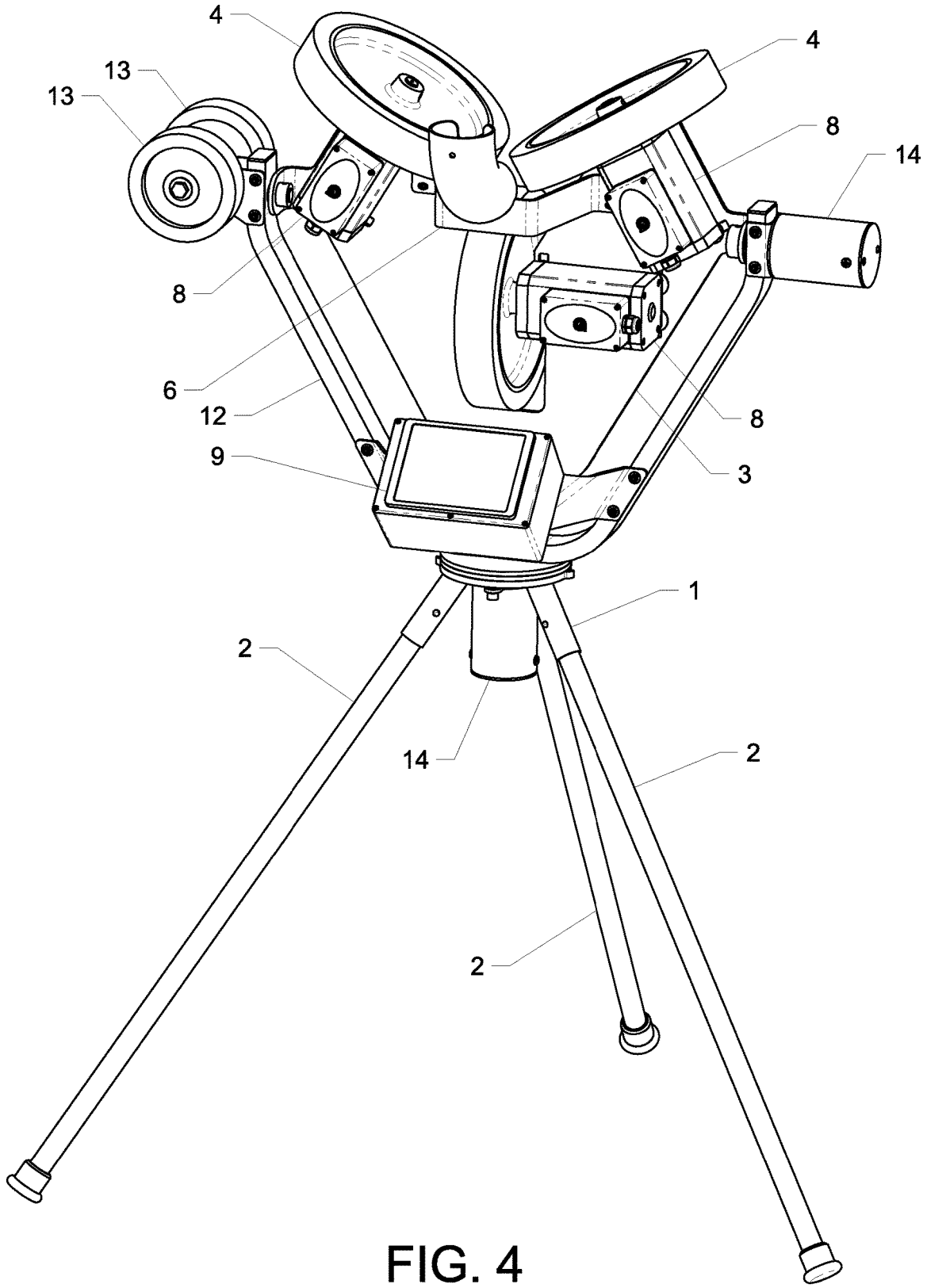
FIG. 4: Automated Three-wheeled system front trimetric view of the present invention.

FIG. 4: automated Three-wheeled front trimetric: Stepper motor housings, 14, are shown. Each stepper motor controls one aiming axis.

Figure 5:
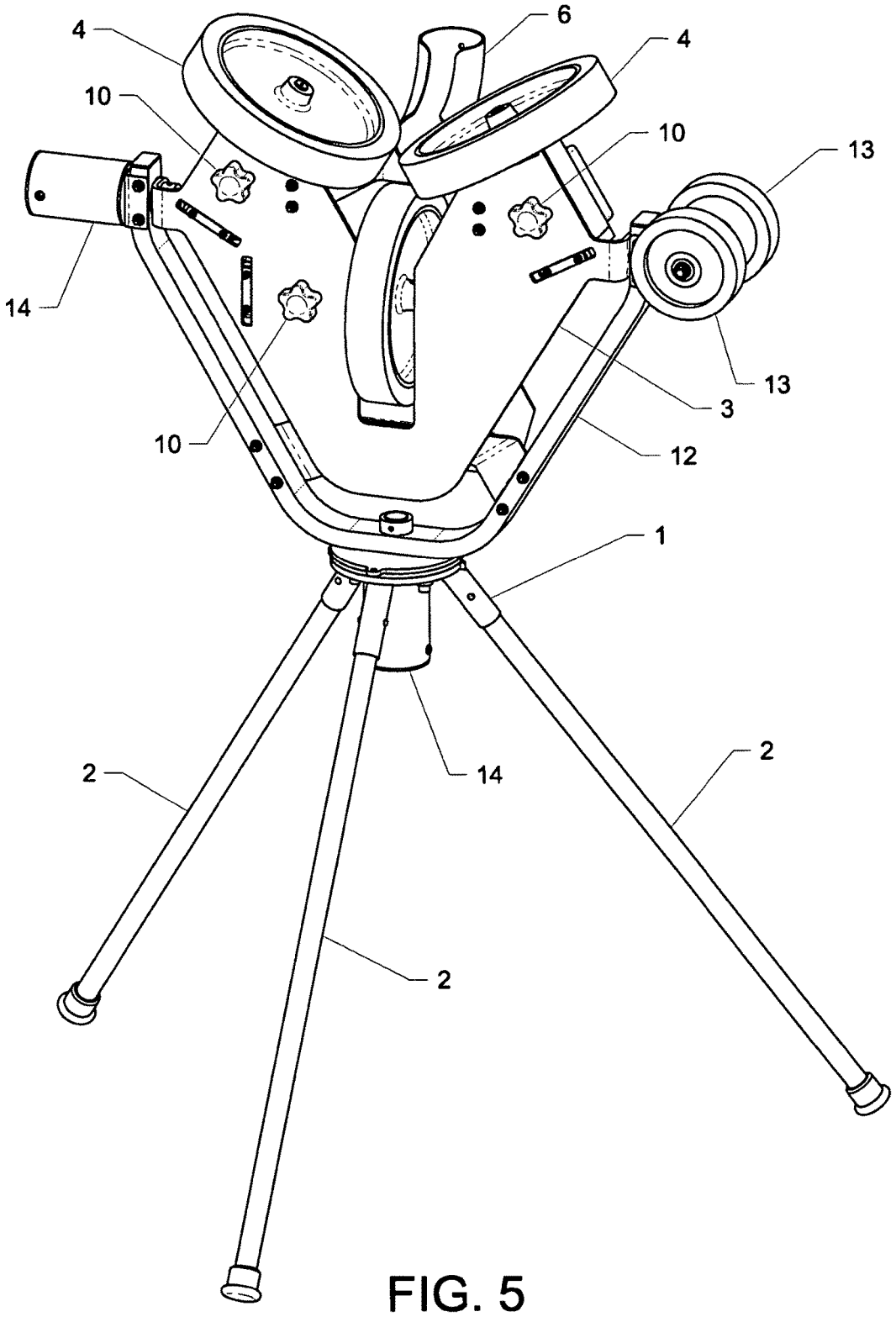
FIG. 5: Three-wheeled system back trimetric: Alternate view of the present invention.

FIG. 5: Three-wheeled Back trimetric: Alternate view of prior features shown.

Figure 6:
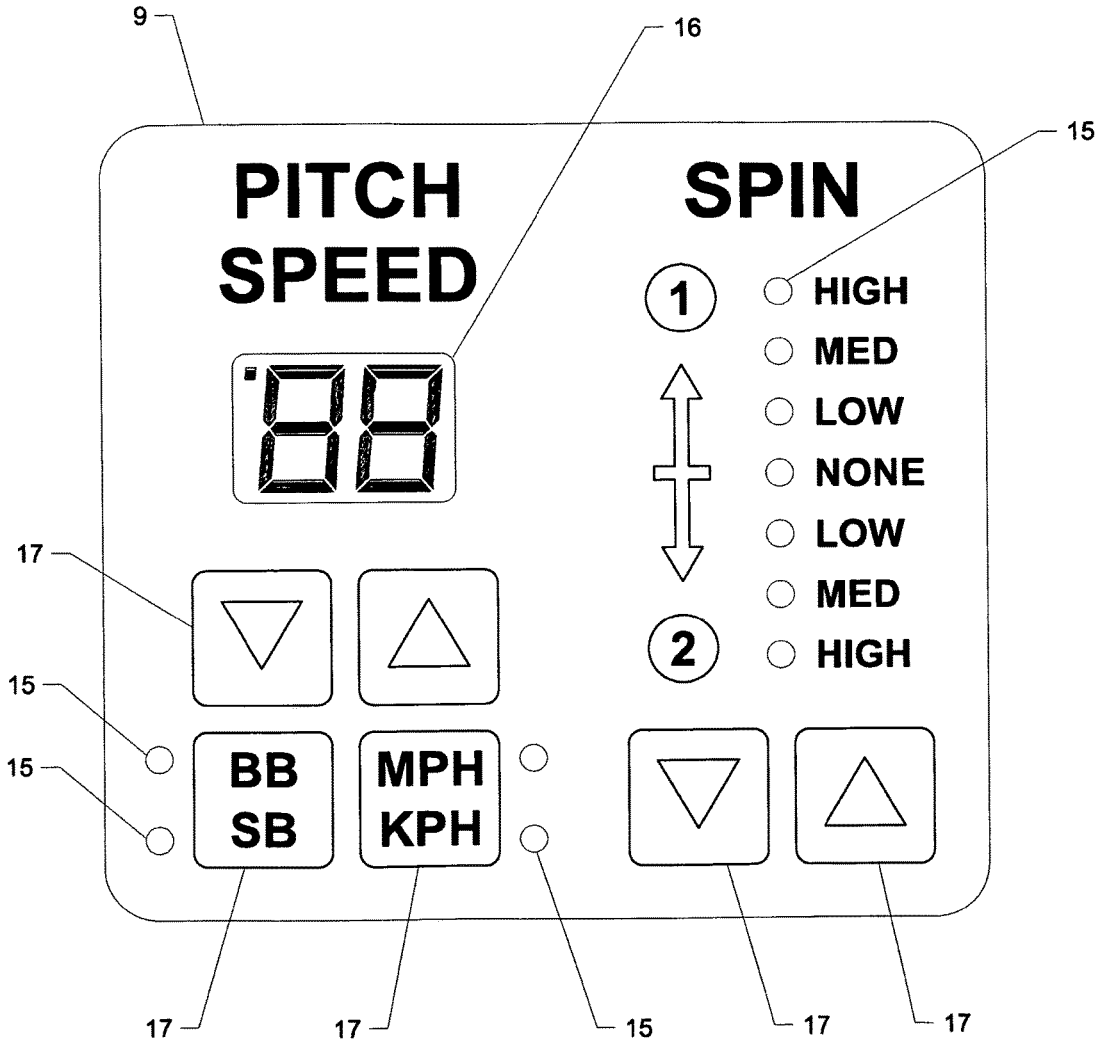
FIG. 6: View of the present invention two-wheeled system control panel.

FIG. 6: Two-wheeled Control panel: Panel is a shown as a membrane switch panel with LED indicators, 15, and 7 segment LED displays, 16. User controls machine by pressing buttons, 17, which are momentary switches. Graphics printed on the panel illustrate to the user how the panel works. Control scheme explained in detail later.

Figure 7:
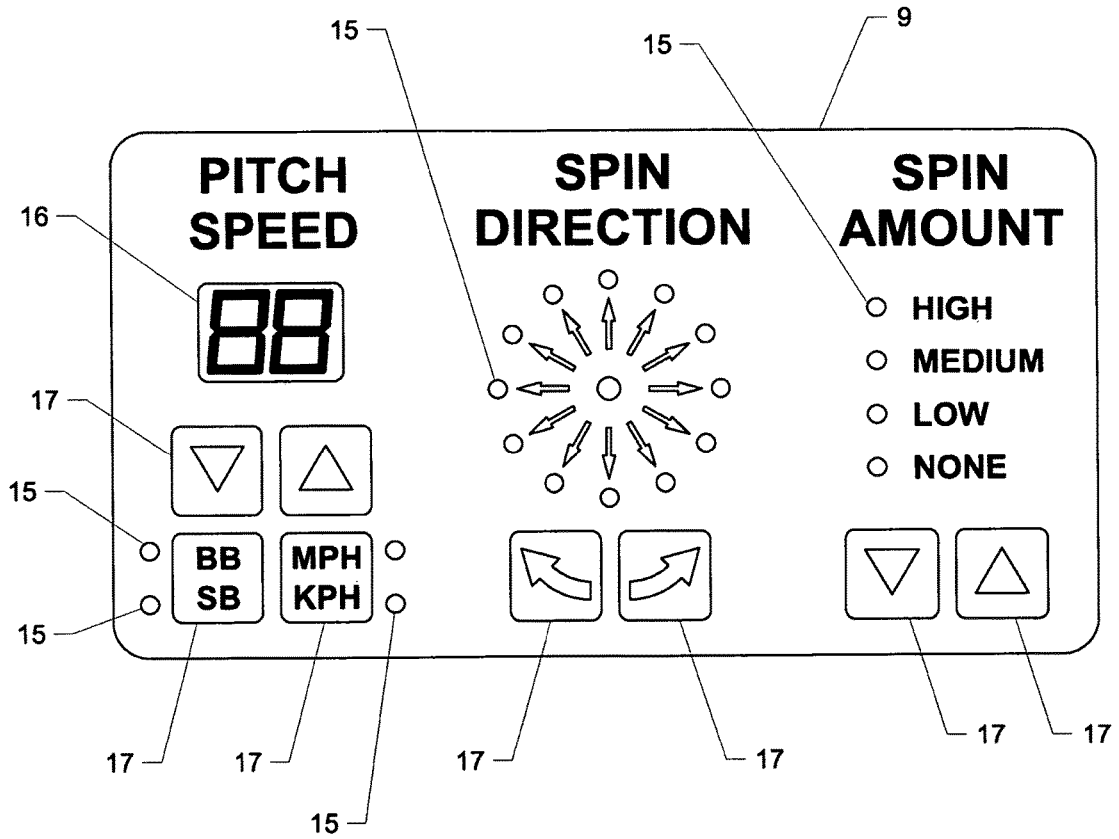
FIG. 7: Front view of the present invention three-wheeled system control panel.

FIG. 7: Three-wheeled Control panel: Same concepts as FIG. 6. Control scheme explained in detail later.

Figure 8:
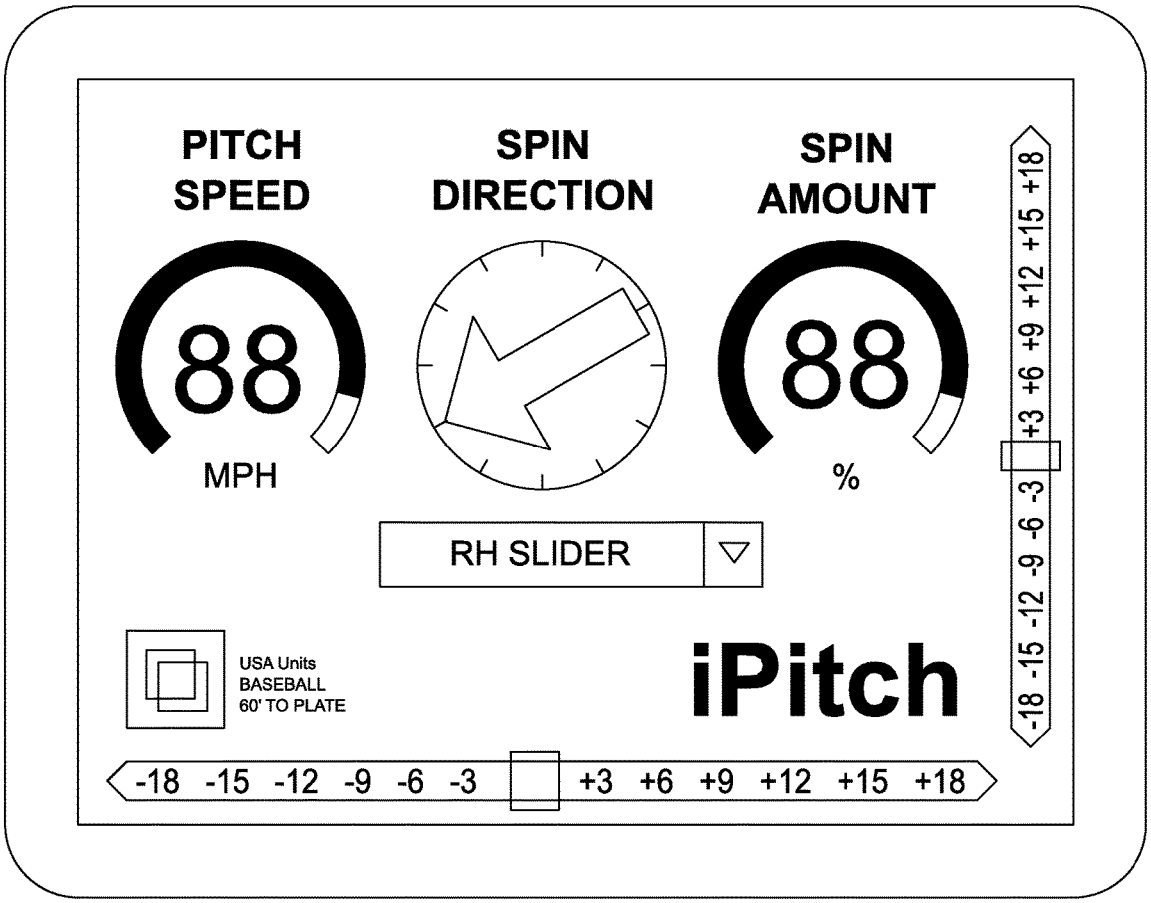
FIG. 8: View of of the present invention Three-wheeled system control panel.

FIG. 8: Three-wheeled Control panel: Control panel adapted for a tablet computer or smart phone screen. Consists of rotary slider widgets for setting pitch speed and spin amount. Spin direction is set by rotating directional arrow widget or by selecting a pitch name from the dropdown. Horizontal and vertical aim are set by linear sliders.

Figure 9:
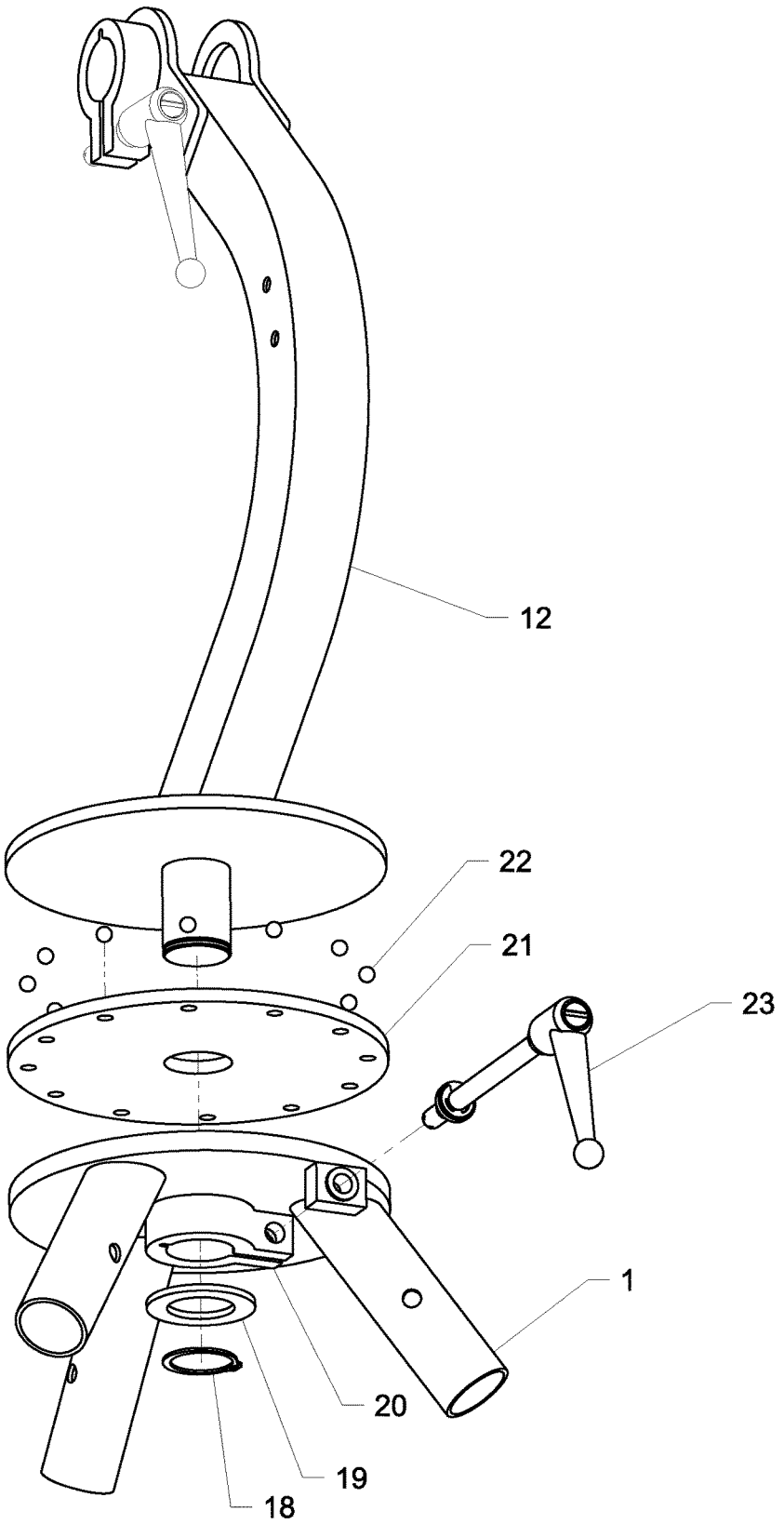
FIG. 9: Perspective view of the present invention detailing two-wheeled system turntable.

FIG. 9: Two-wheeled turntable: Low friction disk, 21, and stainless steel balls, 22, form a large turntable or thrust bearing, allowing upper frame member, 12, to rotate freely relative to tripod base, 1. A shaft clamp, 20, is fixed to the base tripod, 1, allowing a method for locking rotation of 12 when desired. Clamp handle, 23, provides user easy access to partially hidden shaft clamp, 20. Thrust bushing, 19, and retaining ring, 18, keep parts assembled without preventing rotation.

Figure 10:
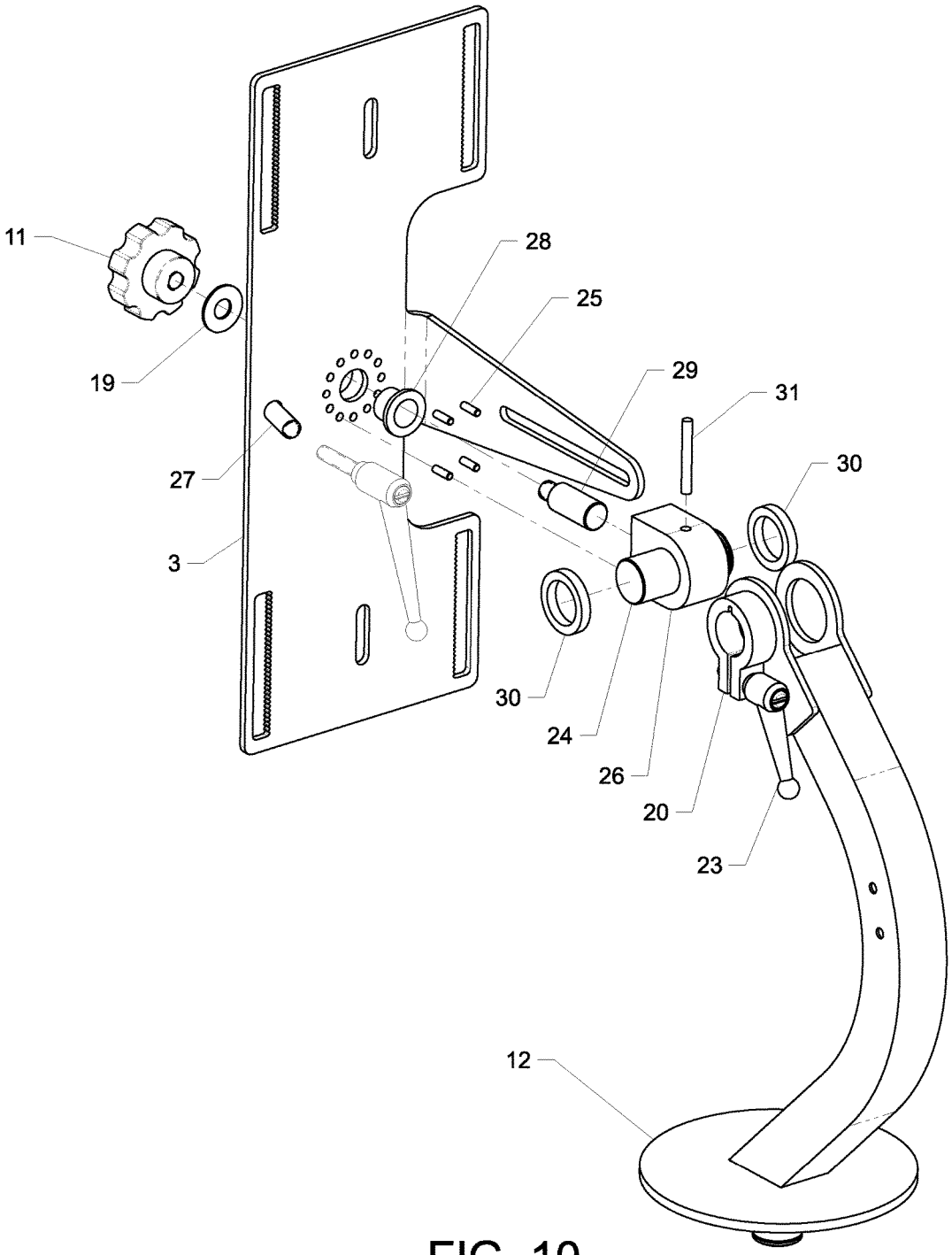
FIG. 10: Perspective view of the present invention detailing two-wheeled system pitch and roll adjustment.

FIG. 10: Two-wheeled pitch and roll adjustment: Machine roll angle is set by rotating motor mounting plate, 3, about shaft, 29. Flanged bushing 28 allows free rotation of said motor mounting plate, and limited axial movement along said shaft. When clamping knob 11, is clamped down, dowel pins, 25, engage in a circle of holes in the motor mounting plate, 3, preventing unintentional rotation. Shaft, 29, and dowel pins, 25, are fixed to a clevis block, 26, which is in turn, fixed to the pitch angle shaft, 24, with dowel pin 31. Clevis block, 26, and pitch angle shaft, 24, rotate freely on ball bearings, 30, mounted on upper frame member, 12. A shaft clamp is fixed to the upper frame member, 12, to lock pitch angle shaft, 24, setting the pitch angle of the motor mounting plate. A handle, 23 with a threaded stud, provides user with a convenient way to close the shaft clamp, 20.

Figure 11:
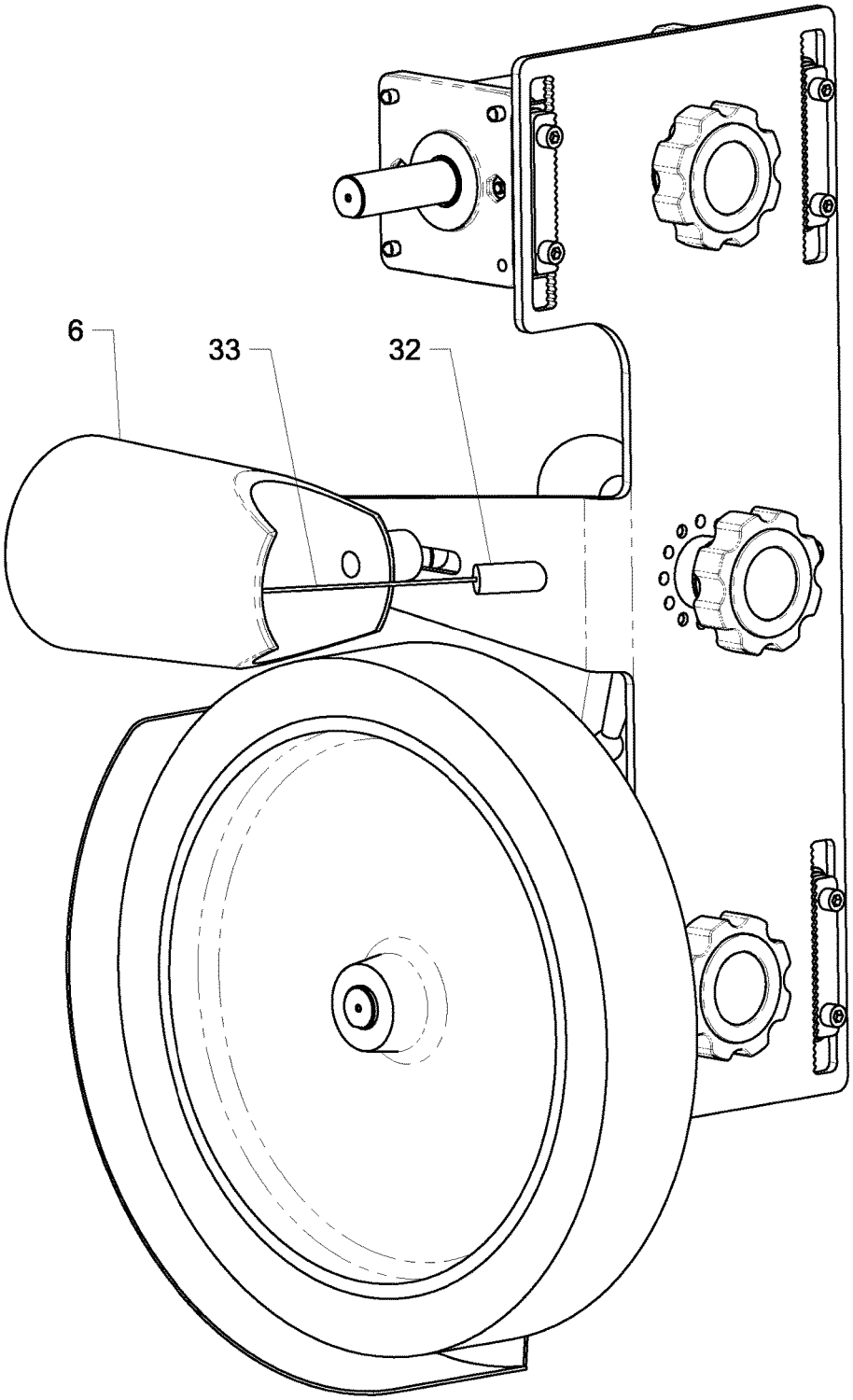
FIG. 11: Detailed view of the present invention ball illumination means.

FIG. 11: Laser pointer/spotlight: A highly focused beam of light, 33, is shot across the path of a ball to be thrown, by a laser pointer or small spotlight, 32. The light beam is not visible to the hitter until a ball crosses its path. Because the beam, 33, is located just before or in close proximity to the point where the ball is launched, the appearance of the beam on the ball acts as a visible indicator that a pitch is imminent or occurring. This light, or a subsequent light 32 could also be located some distance closer to the batter, to assist in timing of the pitch by the batter and enable the batter to better focus on the ball.

Figure 12:
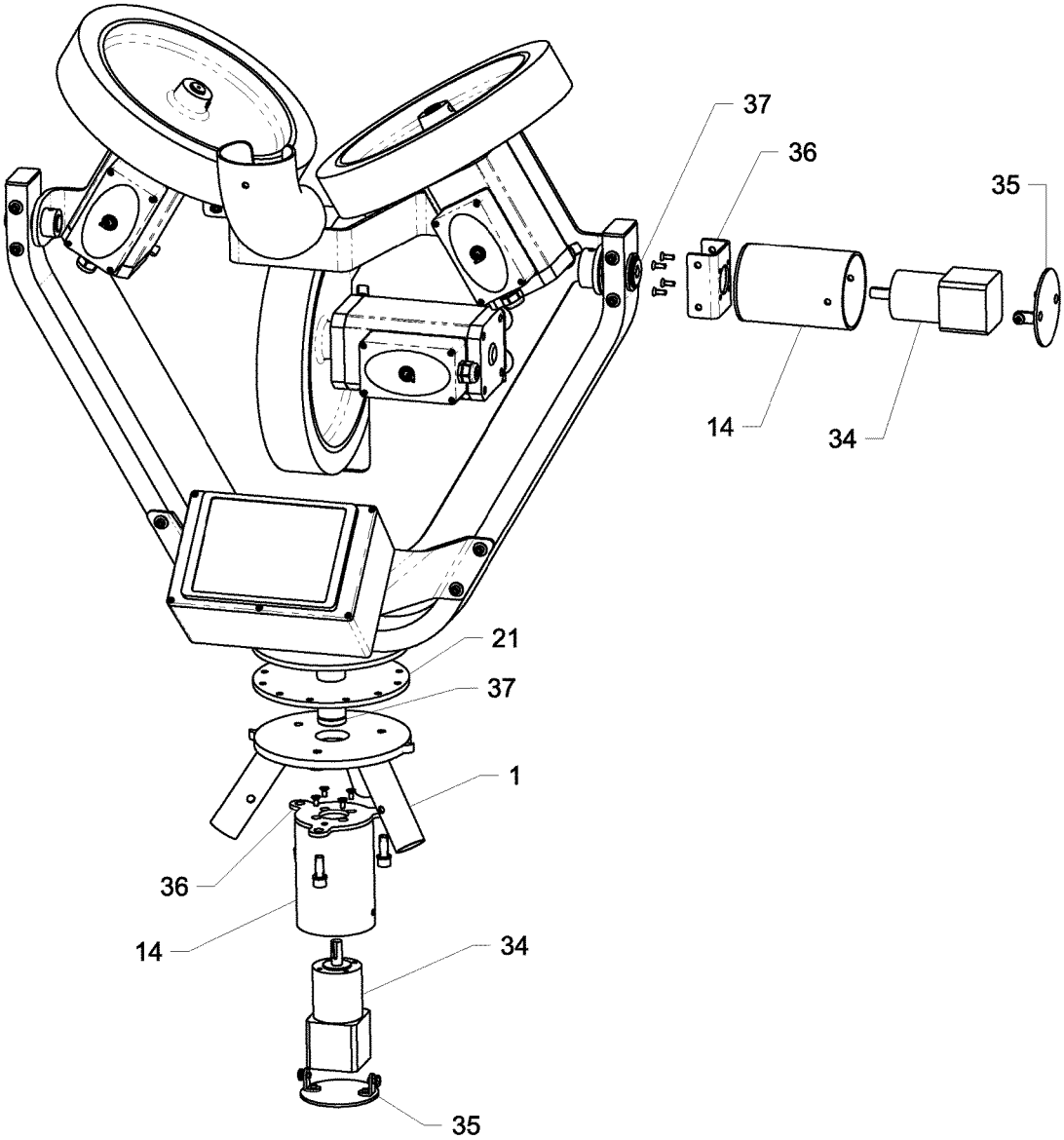
FIG. 12: Exploded view of the present invention detailing stepper motors.

FIG. 12: Stepper motors: The motor mounting plate's yaw and pitch angles are set by geared stepper motors, 34.

Motors are protected by separate housings, 14, which have removable covers, 35. Stepper motors are mounted to the machine with brackets, 36, that allow the use of common parts with machines that are aimed manually. Stepper motor shafts are keyed to transmit torque to hollow shafts, 37. This design allows some axial play between the hollow shaft, 37, and the stepper motor, 34. This prevents any axial load from reaching the stepper motor and damaging it, while also minimizing tangential play that would affect accuracy.

Figure 13:
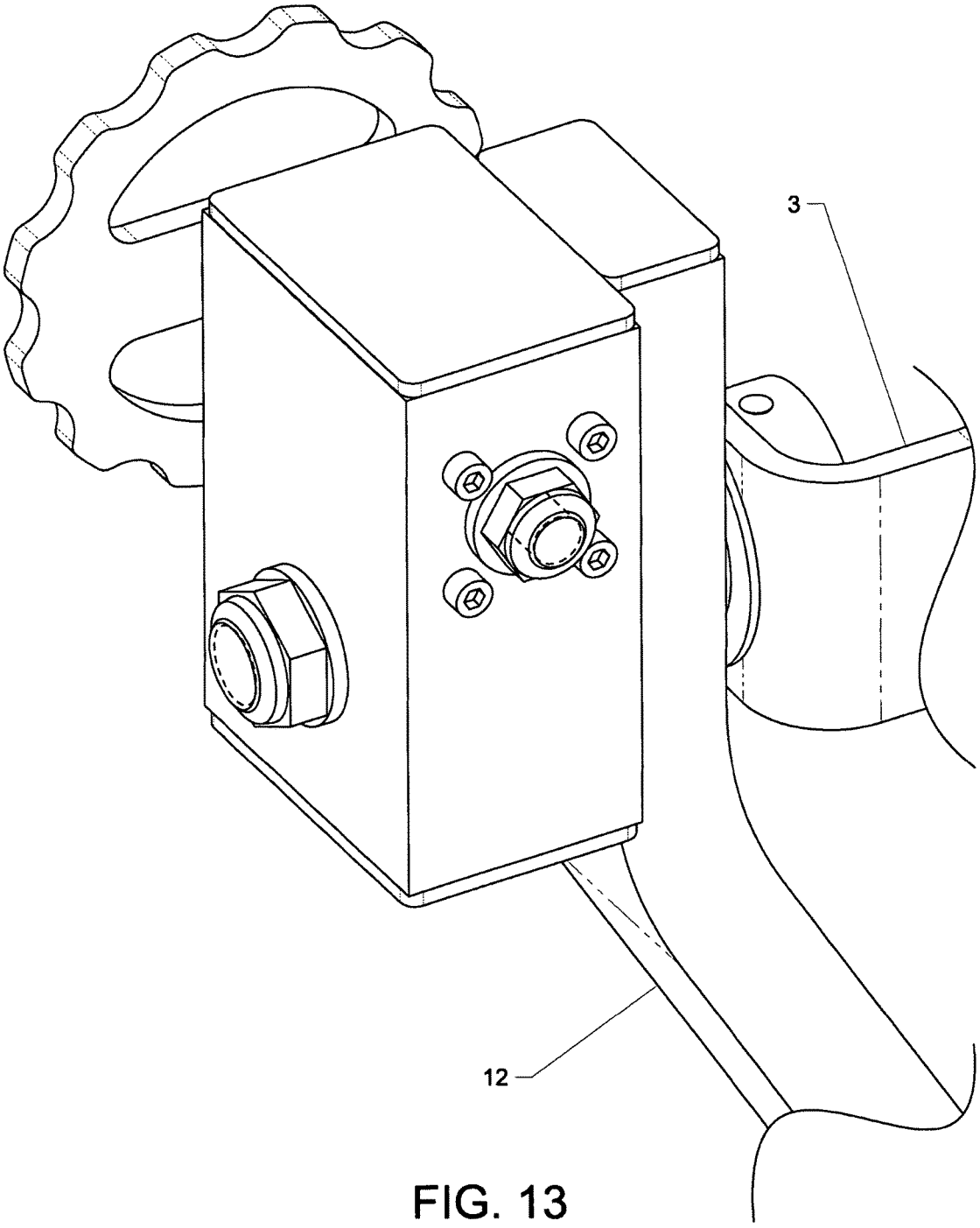
FIG. 13 Enlarged perspective view of present invention worm gears.
Figure 14:
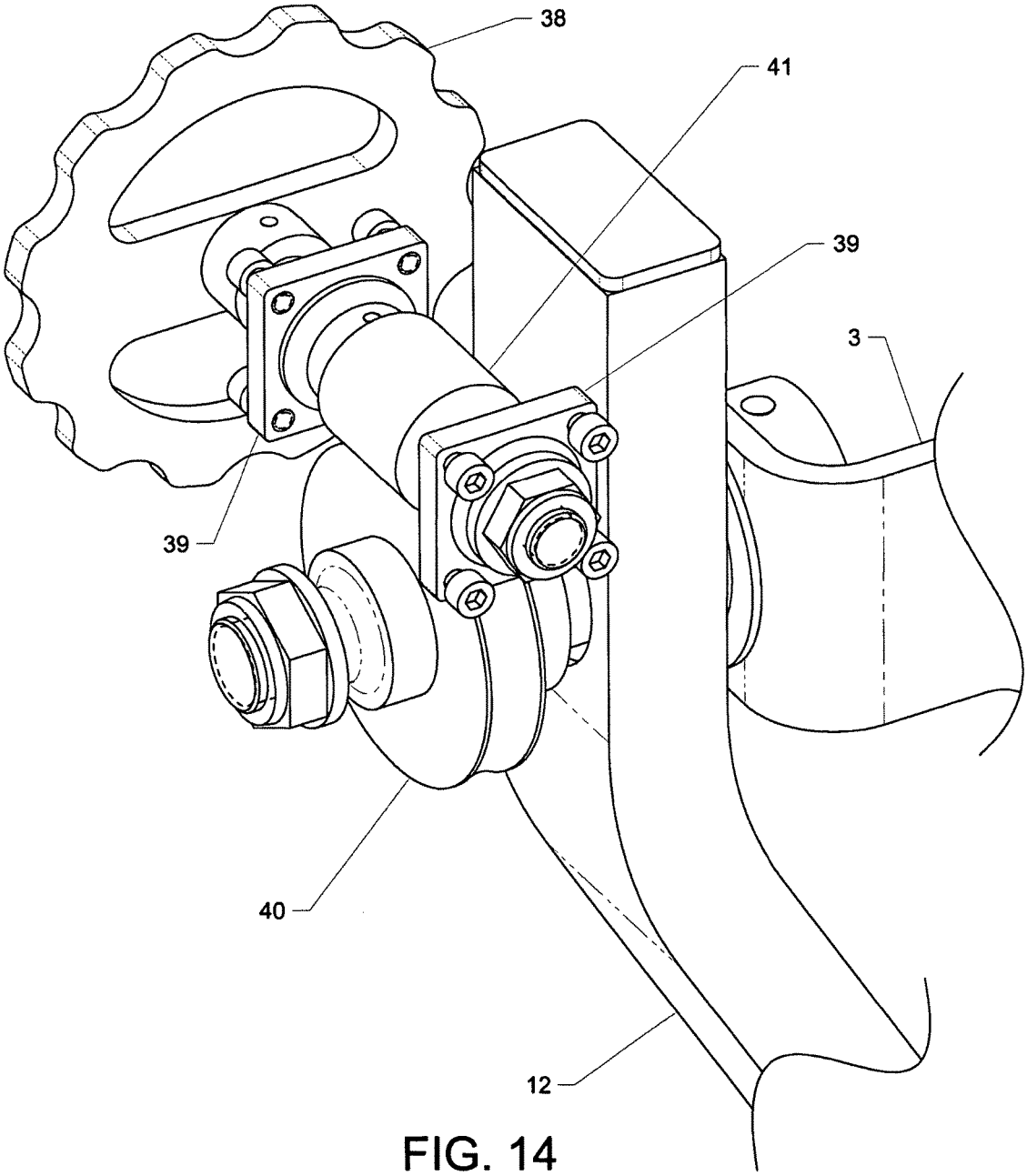
FIG. 14: Alternate view of present invention worm gears1

FIGS. 13 and 14: Worm gears: Worm gears provide a fixed, unchanging ratio between input rotation angle and output rotation angle, which a threaded rod arrangement such as the Sports Attack machine does not. The design is self locking because it can not be back driven. User turns hand wheel, 38, which rotates the worm, 41 inside mounted ball bearings, 39. As the worm, 41, rotates, so does worm gear, 40. Worm gear 40 is attached to motor mounting plate, 3, so turning the hand wheel 38 provides a highly leveraged, self locking method of rotating the motor mounting plate, 3, relative to 12, setting the pitch angle of the machine.

Figure 15:
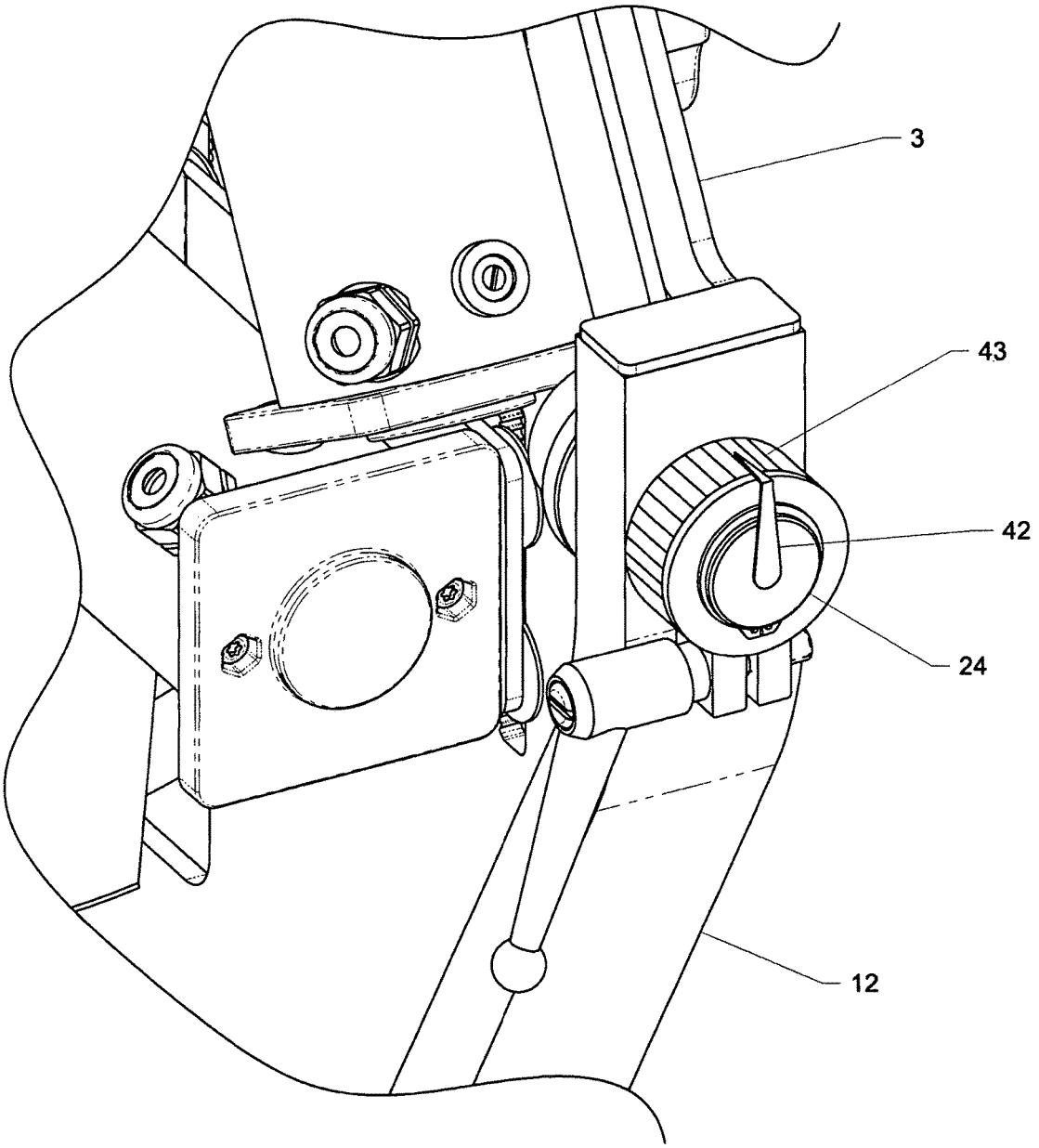
FIG. 15: Enlarged perspective view of present invention Angle indicator

FIG. 15: Angle indicator: An indicating pointer, 42, is attached to horizontal shaft, 24, so that the pointer rotates with the shaft, and thus also the motor mounting plate, 3. A visual scale, 43, is added to the upper frame, 12. As the machine's pitch angle is adjusted, the user is provided with visual feedback, informing them how far the machine has moved. A similar indicator can be added for horizontal adjustments.

Figure 16:
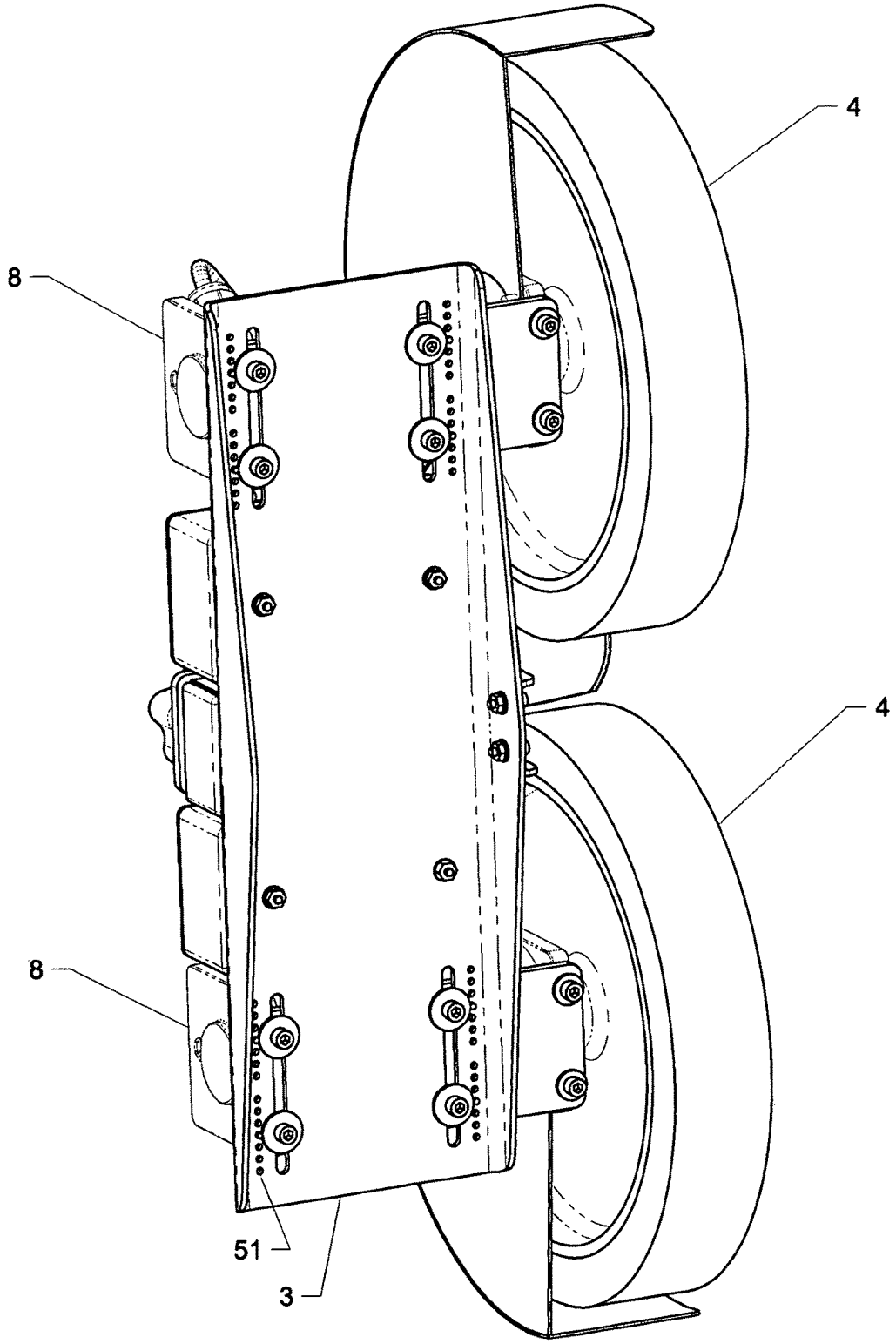
FIG. 16: Enlarged perspective view of present invention pegboard motor locator.

FIG. 16: Pegboard motor locator: Motors, 8, and thus wheels, 4, can be repositioned to adjust the size of the gap between wheels. This is useful for resetting the machine for balls of different size and hardness. The pegboard design consists of a grid of holes, 51 in the motor mounting plate, 3, and dowel pins affixed to the motors, 8. This provides a set of predefined motor and wheel positions for the user.

Figure 17:
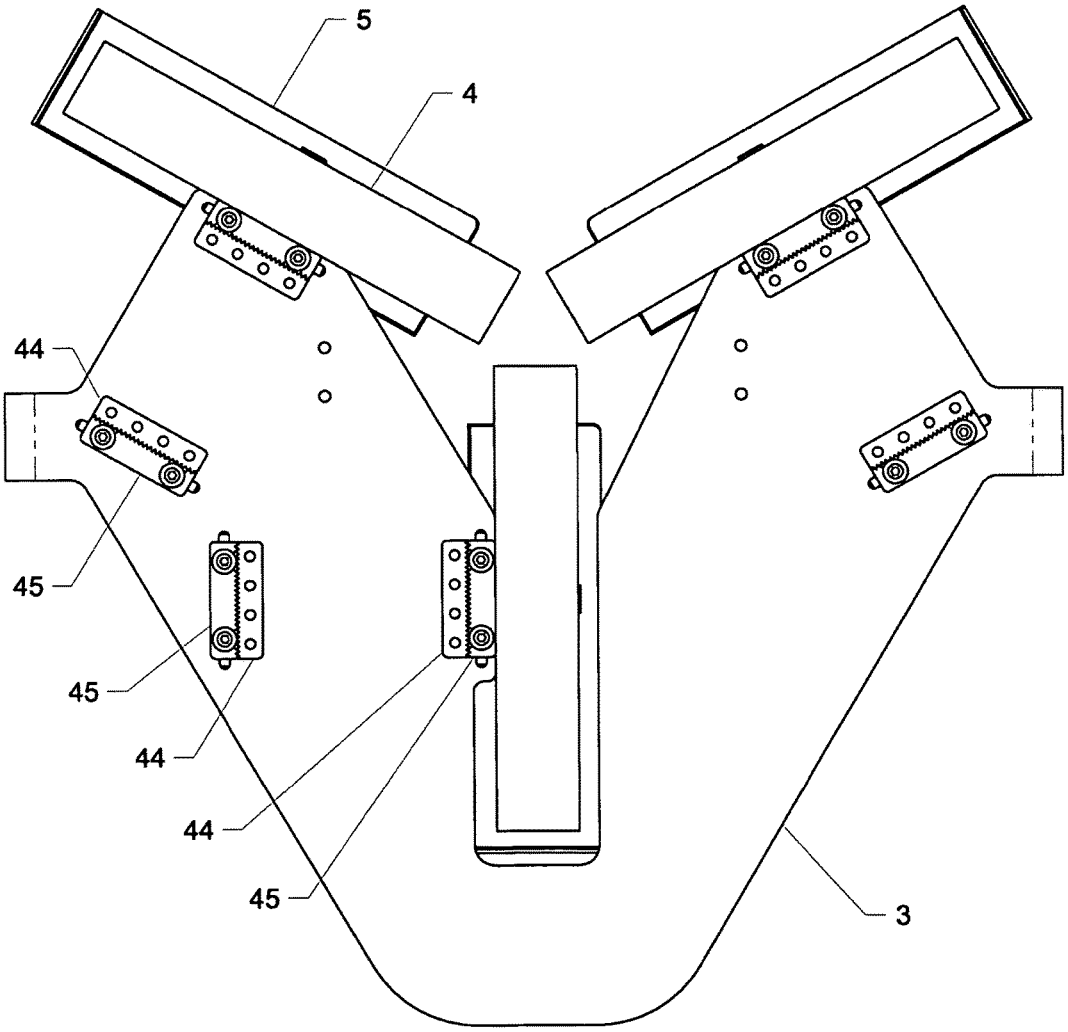
FIG. 17: Front view of present invention Sawtooth motor locator.

FIG. 17: Sawtooth motor locator: Sawtooth shaped plates, 45, are affixed to the motors, 8 and a mating set of sawtooth shaped plates, 44, are affixed to the motor mounting plate. This provides a set of predefined motor and wheel positions for the user. The step size is reduced as compared to the pegboard design, which is limited by the size of the dowels, and the intersection of adjacent grid holes.

Figure 18:
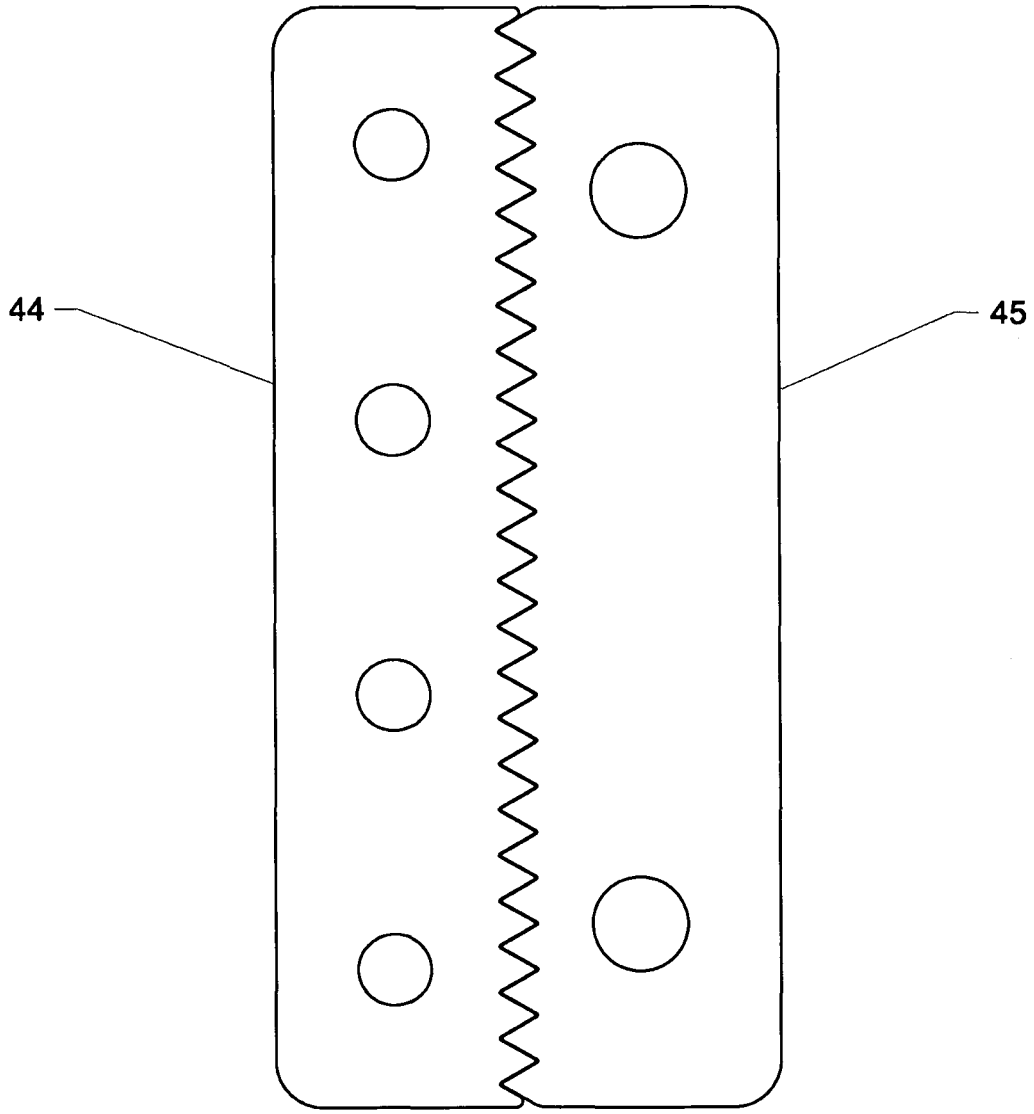
FIG. 18: Enlarged view of present invention Sawtooth.

FIG. 18: Sawtooth Close up: Close up of sawtooth design.

Figure 19:
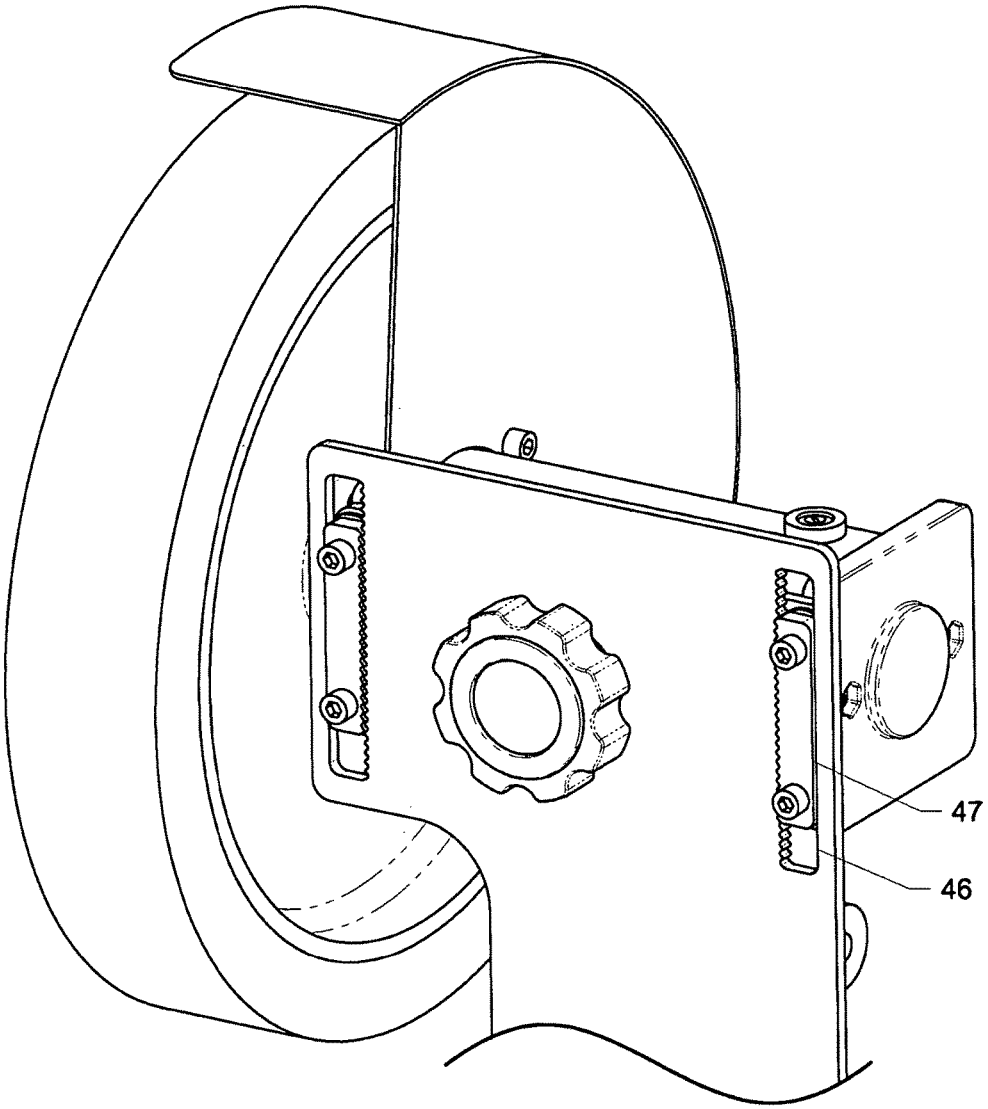
FIG. 19: Enlarged perspective view of present invention profiled block.

FIG. 19: Profiled block: A variation of the sawtooth design, profiled blocks, 47, are affixed to the motors, and mating profiled pockets, 46, are designed into the motor mounting plate, 3. The concept is the same as the sawtooth, but reduces part count.

Figure 20:
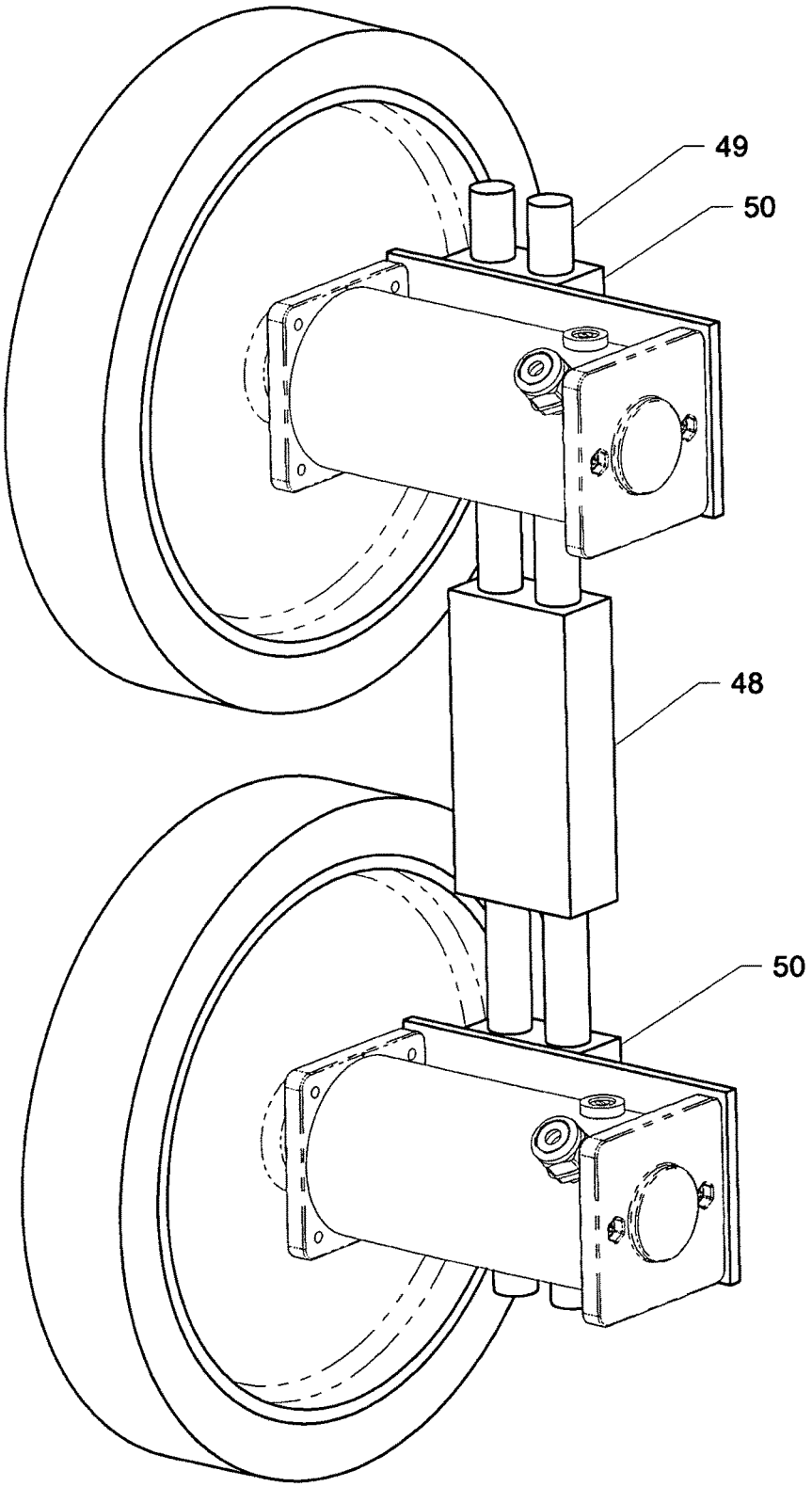
FIG. 20 Enlarged perspective view of present invention Linear bearing machine.
Figure 21:
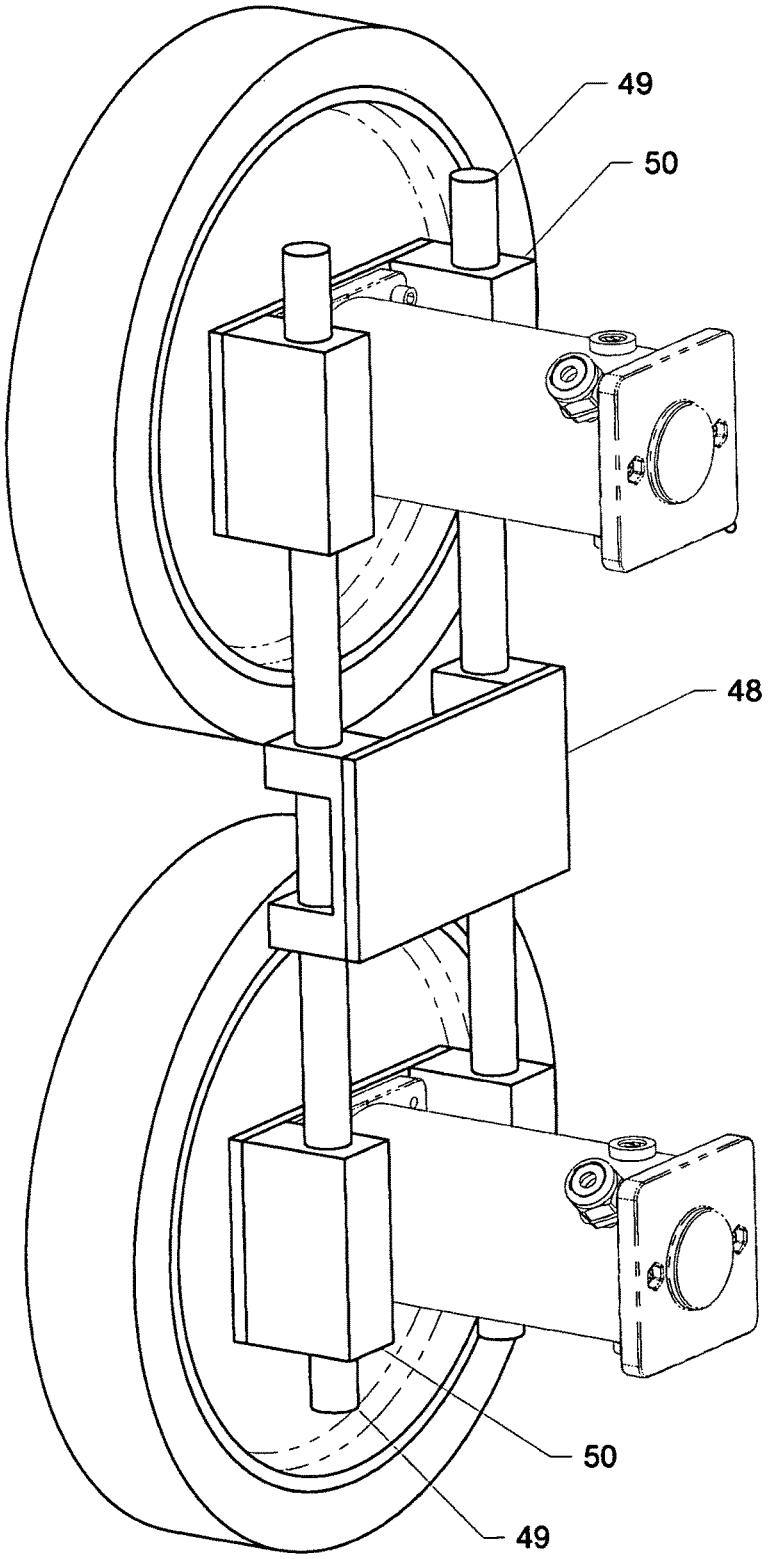
FIG. 21 Enlarged perspective view of present invention bearing means.

FIGS. 20 & 21: Linear bearing machine: Motor mounting plate is replaced with a parallel linear shaft system. Motors, 8, and thus wheels, 4, are mounted on linear bearings, 50. The bearings slide on linear shafts, 49, which are held in place by a fixed center block, 48. As balls are fed into the wheels, 4, the wheels are free to slide, expanding the wheel gap. This provides shock absorption and a longer contact time between ball and wheel. It also greatly reduces sensitivity to using balls of slightly different sizes or hardness. Expanding the range of motion allows the same basic design to be used for various sized balls of different sports. The motors may be spring loaded to return them to position after a ball has been thrown, but the inertia of the motor may in many cases provide the ball clamping force needed to properly grip the ball. The same basic two shaft layout may be used without the shock absorbing function by replacing one of the linear shafts with a shaft threaded half left-hand, half right-hand. As the shaft is turned, the motors would both move in or out from the center position. This provides a convenient way to quickly adjust the size of the ball gap.

Figure 22:
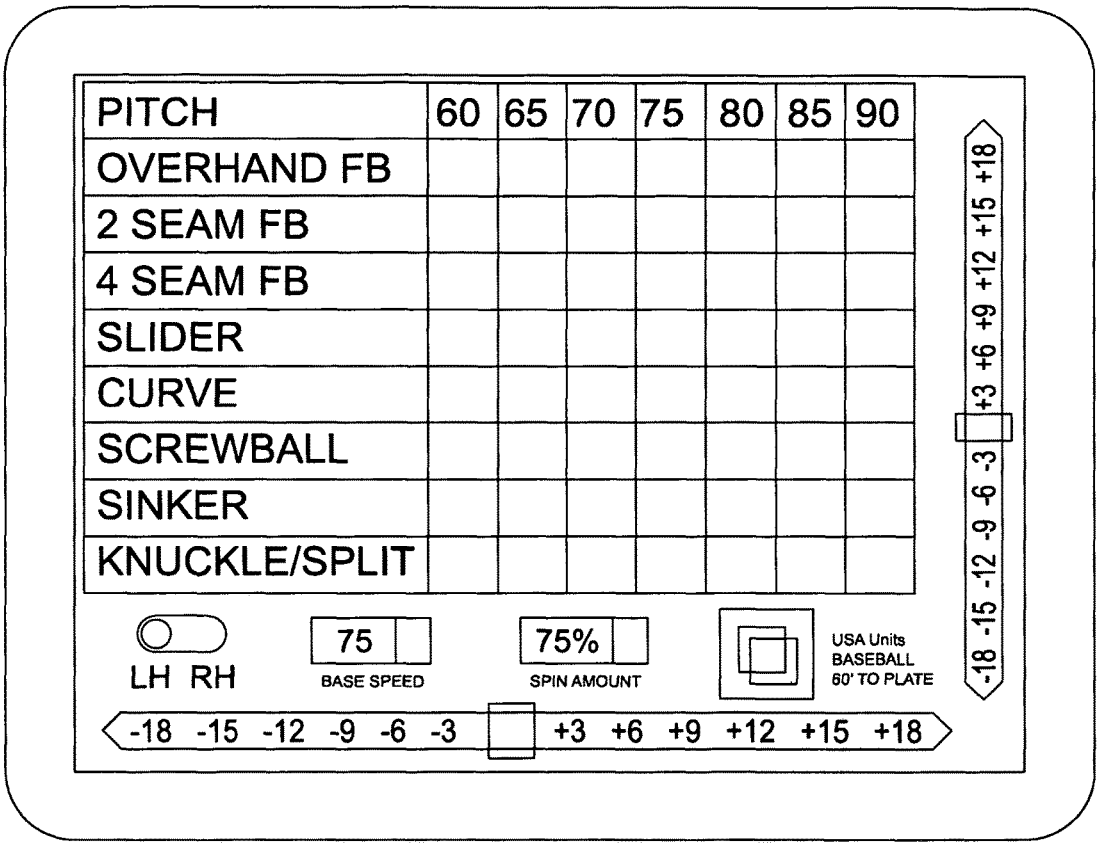
FIG. 22: Front view of present invention rectangular grid HMI screen.

FIG. 22: Rectangular grid Rectangular grid of pitches provides a multitude of pitches which can be selected by single touch.

Figure 23:
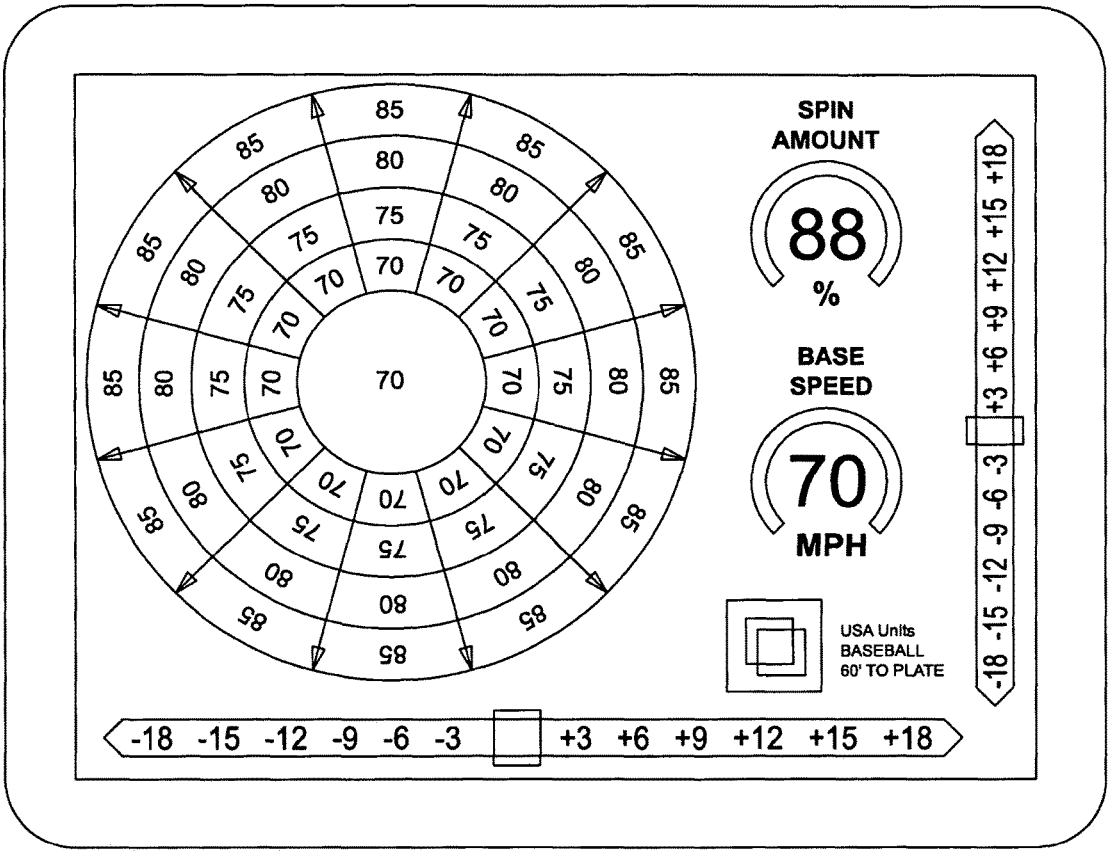
FIG. 23: Front view of present invention Polar grid HMI screen.

FIG. 23: Polar grid: Polar grid of pitches provides a multitude of pitches which can be selected by single touch. Polar layout provides graphical representation of which direction ball will curve.

Figure 24:
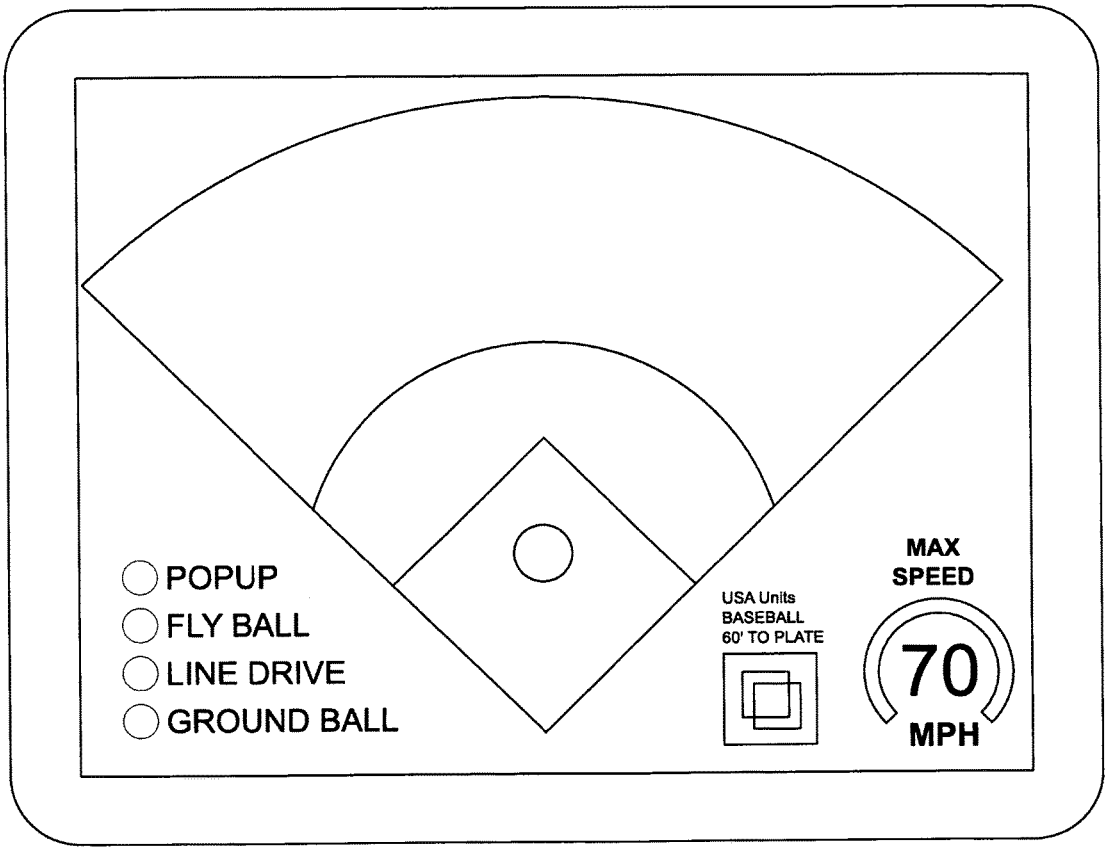
FIG. 24: Front view of present invention HMI defensive-drill screen.

FIG. 24: Defensive screen: Place machine at home plate, then a single touch positions machine to throw to indicated location on field. User can select ground balls, fly balls, or line drives.

Figure 25:
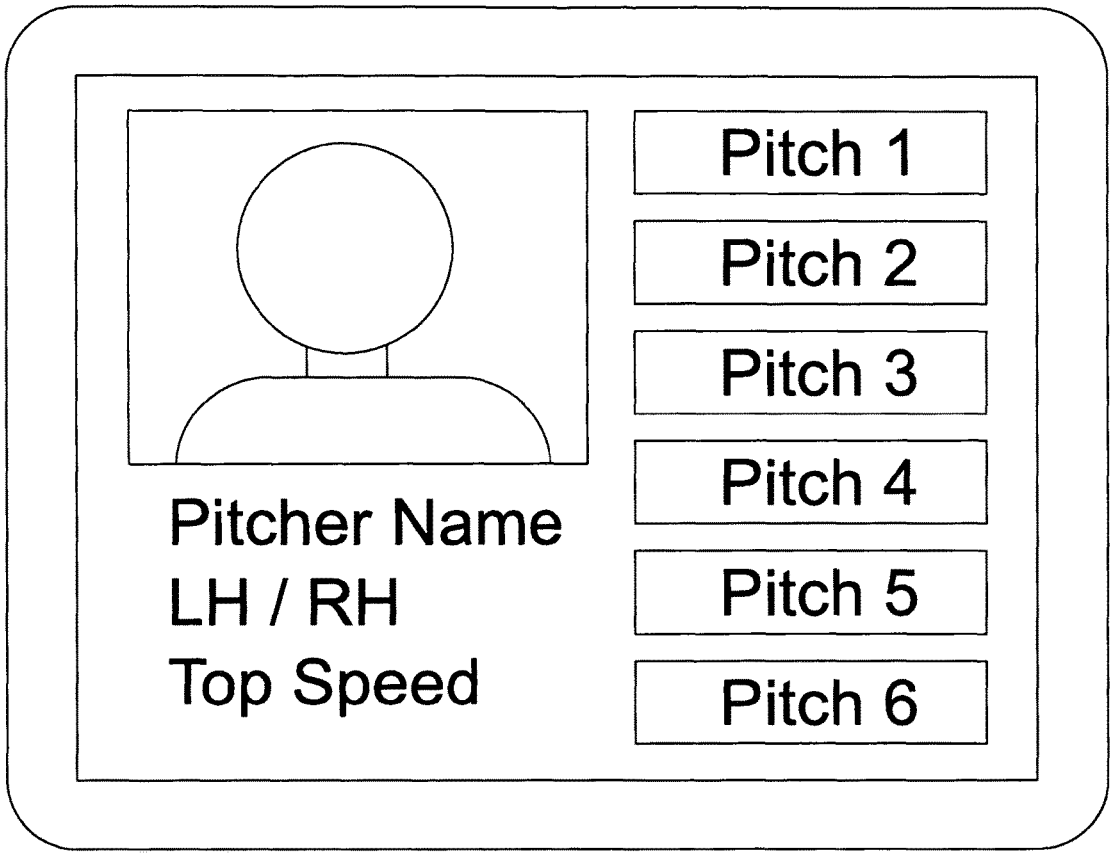
FIG. 25: Front view of present invention HMI specific pitcher select screen.

FIG. 25: Specific pitcher screen: Users can create custom pitchers, each with a picture, a top speed, and a set of pitches. Each of these pitches can be customized to exactly match real or fictional pitchers using same parameters as screen 1—(pitch speed, spin direction, spin amount). Machine can be provided to customer with a library of these pitchers, or users can create their own. Because the machine aim is automatically calculated based on the pitch parameters, the trial and error method of aiming the machine of prior art is eliminated.

As shown in the Figures referred to above, the game ball throwing machine is a diamond sport ball throwing machine, such as for baseball or softball. Other throwing machines can be utilized, such as those for soccer, football, lacrosse, cricket, basketball, and the like, and are contemplated by this disclosure. Turning now to FIG. 1, the device includes a base means 1 such as the indicated tripod, comprising three or more interchangeable legs 2, motor mounting plate 3 securing one or more powered rotating wheel(s) 4 for propelling a round object such as a ball, forward or imparting spin or a combination of propulsion or spin.

In diamond sports, the game ball throwing machine is generally described as a pitching machine. For simplicity's sake that term will be used forward. The pitching machine generally includes wheels 4 that spin and are used to impart force to the ball to project the ball towards a target. The wheels are driven by motors 8 which are adjusted and controlled by a series of controls 9. The pitching machine has an intake opening 6 positioned and sized to receive a ball and deliver that ball to the wheels 4 for the pitching machine. The game balls (not shown) typically have two hemispheres wherein each hemisphere is engaged by one or more of the wheels 4 to impart the force to propel the ball to its target. Around each wheel 4 is preferably a wheel guard 5. Located generally equidistant between the wheels is a ball feeder tube 6 for delivering the ball forward into the pinch point of the wheels 4.

Preferably attached to the motor mounting plate is an interchangeable, removable handle 7 which may be used to manually adjust the vertical and horizontal primary aimpoint of the two-wheeled pitching machine. Attached mechanically to the mounting plate 3, wheel 4 and guard 5 is a motor 8, control panel 9, motor clamping knob 10, two-wheeled system twist adjustment clamp 11, and rotating top frame 12.

As indicated in the description of FIG. 10 above, the shaft collar/clamp handle 23 connects to the shaft vertical aim adjustment means 24. A dowel pin 25 is connected to the clevis block 26, and a handle mounting stud 27 is provided on motor mounting plate 3.

Generally, the pitching machine includes a base 1, a support frame 12 attached to the base, a drive mechanism attached to the support frame, and a control panel 9 that can be attached to the support frame or can have a wireless connection such as through a tablet computer or smart phone screen as described above. The base can be a base as known in the art that allows for height adjustment of the pitching machine with the game ball feeder. The drive mechanism can be those drive mechanisms known in the art, including various types of motors 8 that can run off AC power, DC power, or both, as desired.

Thus, although there have been described particular embodiments of the present disclosure of a new and useful AUTOMATIC GAME BALL PITCHING MACHINE it is not intended that such references be construed as limitations upon the scope of this disclosure except as set forth in the following claims.

The invention claimed is:

1. A game ball throwing machine, comprising:

a base;

a support frame attached to the base;

at least one drive wheel mechanism attached to the support frame, wherein a rotating mechanism for the drive wheel mechanism is an electric motor;

a human-machine interface containing or otherwise utilizing software which enables customization of at least one parameter from a list comprising:

i. drive wheel rotation speed, ii. ball spin speed and direction, iii. ball speed and, iv. target location, wherein the human-machine interface is further comprised of a graphical display, wherein the graphical display is comprised of a pitch speed indicator, a ball spin direction indicator, and a ball spin amount indicator, wherein the ball spin direction indicator is shown in a polar arrangement with a plurality of optional ball spin directions and at least one of a rotating directional arrow and a light identifying a selected one of the optional ball spin directions, and wherein the ball spin direction indicator is separate from the pitch speed indicator and the ball spin amount indicator;

a support frame indexing element positioned to control the location of the ball target; and a resident software program integrating the throwing machine, indexing element and human-machine interface.

2. The game ball throwing machine of claim 1, wherein the human-machine interface includes a grid representation of a multitude of pitch locations and spin intensities.

3. The game ball throwing machine of claim 2, wherein the human machine interface wirelessly signals the machine indexing element and drive wheel mechanism the calculated values to adjust where and with what speeds and directions of spins to pitch each ball.

4. The game ball throwing machine of claim 1, further comprising a ball visualization aid, wherein the ball visualization aid is at least one of a light source and a gap, wherein the light source illuminates the ball at one or more locations between the area behind the drive wheel before launch and the batter, and wherein the gap is formed in the tube feeding balls forward to the drive wheel.

5. The game ball throwing machine of claim 1, further comprising a gear, a frame drive mechanism, and a ball diameter compensation element, wherein the gear is operatively attached to the support frame and the frame drive mechanism, and wherein the drive mechanism and the gear rotate the support frame to change the aim point of the machine.

6. The software of claim 1 comprising a program utilizing the iterative steps of inputs from a keypad or touch screen interface, processing those inputs in the application of arithmetic formulae resulting in output signals to one or more mechanisms on a pitching machine to adjust a pitching machine aimpoint, wheel speed, ball speed, ball spin speed and ball spin direction, said inputs consisting of one or more of the following:

i) visual aimpoints on a grid above a representation of a batter's box homeplate ii) pitch type iii) ball spin intensity iv) ball spin direction v) ball pitch velocity vi) target area vii) target type or viii) player to be simulated.

7. The game ball throwing machine of claim 1, wherein the at least one drive wheel mechanism is further comprised of at least a first drive wheel mechanism and a second drive wheel mechanism, wherein the human-machine interface is further comprised of a ball type input selection comprised of a baseball option and a softball option, wherein the ball speed is displayed on a pitch speed indicator, and wherein the software adjusts the ball speed displayed on the pitch speed indicator depending on the ball type input selection.

8. A game ball throwing machine, comprising:

a base;

a support frame attached to the base;

at least one drive wheel mechanism attached to the support frame, and a human-machine interface which enables customization of drive wheel rotational speed, ball spin, ball speed and target location;

a support frame indexing element positioned to control the location of the ball target;

a light source illuminating a portion of the ball at one or more locations between the entrance to the drive wheel and the midpoint between the drive wheel and the batter; and a resident software program integrating the throwing machine, indexing element and human-machine interface.

9. The game ball throwing machine of claim 8, wherein the human-machine interface is further comprised of a graphical display, wherein the graphical display is comprised of a pitch speed indicator, a ball spin direction indicator, and a ball spin amount indicator, wherein the ball spin direction indicator is shown in a polar arrangement with a plurality of optional ball spin directions and at least one of a rotating directional arrow and a light identifying a selected one of the optional ball spin directions, and wherein the ball spin direction indicator is separate from the ball speed shown on the pitch speed indicator and the ball spin shown on the ball spin amount indicator.

10. The game ball throwing machine of claim 9, further comprising a plurality of wheel speed controllers connected to the spinning drive wheels and a computer processor in operative communication with the human-machine interface and with the plurality of wheel speed controllers, wherein the human-machine interface is further comprised of a pitch speed user control, a ball spin direction user control, and a ball spin amount user control, wherein a first user input is made to the pitch speed user control, wherein a second user input is made to the ball spin direction user control, wherein a third user input is made to the ball spin amount user control, wherein the computer processor receives the first user input, the second user input and the third user input, wherein the resident software program running on the computer processor is comprised of a set of wheel rotation equations which calculate a set of wheel speeds according to the first user input, the second user input, and the third user input entered into variable user input entries in the wheel rotation equations, and wherein the processor communicates the set of wheel speeds to the wheel speed controllers as a set of wheel speed control signals.

11. The game ball throwing machine of claim 10, further comprising a ball diameter compensation element, wherein the resident software program enables wireless control, programming and customization of pitching parameters, wherein the human-machine interface is at least one of a physical panel structure connected to the support frame and an electronic panel screen for a mobile computing device, wherein the human-machine interface is further comprised of a ball type input selection comprised of a baseball option and a softball option, and wherein the resident software program adjusts the ball speed displayed on the pitch speed indicator depending on the ball type input selection.

12. A throwing machine for a ball, comprising:

a base;

a support frame attached to the base;

a plurality of drive wheel mechanisms attached to the support frame, wherein each one of the drive wheel mechanisms is comprised of a spinning wheel, a motor connected to the spinning wheel and a wheel speed controller, and wherein the drive wheel mechanisms engage the ball to be thrown by the throwing machine;

a human-machine interface comprising a graphical display and a plurality of user controls, wherein the user controls are comprised of a pitch speed user control with a first input, a ball spin direction user control with a second input, and a ball spin amount user control with a third input, wherein the graphical display is comprised of a pitch speed indicator, a ball spin direction indicator, and a ball spin amount indicator, wherein the ball spin direction indicator is shown in a polar arrangement with a plurality of optional ball spin directions, and wherein the ball spin direction indicator is separate from the pitch speed indicator and the ball spin amount indicator; and a computer processor in operative communication with the human-machine interface and with the wheel speed controller in each one of the drive wheel mechanisms, wherein the computer processor comprises a set of wheel rotation equations having variable user input entries, wherein the computer processor receives the first input, the second input and the third input, wherein the set of wheel rotation equations calculate a set of wheel speeds according to the first input, the second input, and the third input entered into the variable user input entries in the wheel rotation equations, and wherein the processor communicates the set of wheel speeds to a corresponding one of each wheel speed controller as a set of wheel speed control signals.

13. The game ball throwing machine of claim 12, wherein the human-machine interface is at least one of a physical panel structure connected to the support frame and an electronic panel screen for a mobile computing device, wherein the polar arrangement is further comprised of at least one of a rotating directional arrow and an illuminated light, and wherein the rotating directional arrow and the illuminated light graphically identify a selected one of the optional spin directions that is the second input for the ball spin direction user control.

14. The game ball throwing machine of claim 12, wherein the human-machine interface is at least one of a physical panel structure connected to the support frame, wherein the polar arrangement is further comprised of a plurality of arrows corresponding with the optional ball spin directions and a plurality of lights respectively positioned adjacent to corresponding tips of the arrows, and wherein one of the lights is illuminated and graphically identifies a selected one of the optional spin directions that is the second input for the ball spin direction user control.

15. The game ball throwing machine of claim 12, wherein the first input for the pitch speed user control is a ball speed shown on the pitch speed indicator, wherein the second input for the ball spin direction user control is an angular direction shown in graphical form on the ball spin direction indicator, wherein the third input for the ball spin amount user selection is a percentage of a maximum ball spin amount shown on the ball spin amount indicator, and wherein the maximum ball spin amount corresponds to a maximum tangential wheel speed difference between the plurality of drive wheel mechanisms.

16. The game ball throwing machine of claim 15, wherein the human-machine interface is further comprised of a ball type input selection comprised of a baseball option and a softball option, wherein the ball speed is displayed on the pitch speed indicator, wherein the computer processor adjusts the ball speed displayed on the pitch speed indicator depending on the ball type input selection, and wherein the set of wheel rotation equations are further comprised of the maximum tangential wheel speed difference multiplied by the third input for the ball spin amount user selection and multiplied by a trigonometric function of the difference between a wheel position angle and the spin direction selection.

17. The game ball throwing machine of claim 12, wherein the ball spin direction user control is at least one of a button switch, a rotary potentiometer, and a rotary directional arrow widget.

18. The game ball throwing machine of claim 12, further comprising a light source illuminating a portion of the ball at one or more locations between the entrance to the drive wheel mechanisms and the launch of the ball at the exit.

19. The game ball throwing machine of claim 12 further comprised of a support frame indexing element positioned to control the location of the ball target and a ball diameter compensation element, wherein the computer processor integrates the support frame indexing element and a pitch location input on the human-machine interface, and wherein the pitch location input is comprised of an x-slide amount and a y-slide amount.

20. A game ball throwing machine, comprising:

a base;

a support frame attached to the base;

at least one drive wheel mechanism attached to the support frame, wherein the at least one drive wheel mechanism is further comprised of at least a first drive wheel mechanism and a second drive wheel mechanism;

a human-machine interface containing or otherwise utilizing software which enables customization of at least one parameter from a list comprising a drive wheel rotation speed, a ball spin speed and direction, a ball speed and a target location, wherein the human-machine interface is further comprised of a ball type input selection comprised of a baseball option and a softball option, wherein the ball speed is displayed on a pitch speed indicator, and wherein the software adjusts the ball speed displayed on the pitch speed indicator depending on the ball type input selection;

a support frame indexing element positioned to control the location of the ball target; and a resident software program integrating the throwing machine, indexing element and human-machine interface.

21. The game ball throwing machine of claim 20, wherein a rotating mechanism for the drive wheel mechanism is an electric motor, and wherein the human-machine interface is further comprised of a graphical display, wherein the graphical display is comprised of a pitch speed indicator, a ball spin direction indicator, and a ball spin amount indicator, wherein the ball spin direction indicator is shown in a polar arrangement with a plurality of optional ball spin directions and at least one of a rotating directional arrow and a light identifying a selected one of the optional ball spin directions, and wherein the ball spin direction indicator is separate from the pitch speed indicator and the ball spin amount indicator.

22. The game ball throwing machine of claim 20 further comprising a ball visualization aid, wherein the ball visualization aid is at least one of a light source and a gap, wherein the light source illuminates the ball at one or more locations between the area behind the drive wheel before launch and the batter, and wherein the gap is formed in the tube feeding balls forward to the drive wheel.

23. The game ball throwing machine of claim 20 further comprising a gear and a frame drive mechanism, wherein the gear is operatively attached to the support frame and the frame drive mechanism, and wherein the drive mechanism operates the gear and rotates the support frame to change the aim point of the machine.

* * * * *